US008321216B2

(12) United States Patent
Zopf

(10) Patent No.: US 8,321,216 B2
(45) Date of Patent: Nov. 27, 2012

(54) TIME-WARPING OF AUDIO SIGNALS FOR PACKET LOSS CONCEALMENT AVOIDING AUDIBLE ARTIFACTS

(75) Inventor: Robert W. Zopf, Rancho Santa Margarita, CA (US)

(73) Assignee: Broadcom Corporation, Irvine, CA (US)

( * ) Notice: Subject to any disclaimer, the term of this patent is extended or adjusted under 35 U.S.C. 154(b) by 529 days.

(21) Appl. No.: 12/710,418

(22) Filed: Feb. 23, 2010

(65) Prior Publication Data

US 2011/0208517 A1 Aug. 25, 2011

(51) Int. Cl.
*G10L 21/02* (2006.01)
*G10L 21/04* (2006.01)

(52) U.S. Cl. ..... 704/228; 704/267

(58) Field of Classification Search ..... 704/228, 704/267

See application file for complete search history.

(56) References Cited

U.S. PATENT DOCUMENTS

| | | | | |
|---|---|---|---|---|
| 7,024,358 | B2 * | 4/2006 | Shlomot et al. | 704/241 |
| 7,302,385 | B2 * | 11/2007 | Sung et al. | 704/219 |
| 7,746,382 | B2 * | 6/2010 | Soupliotis et al. | 348/208.99 |
| 7,877,253 | B2 * | 1/2011 | Krishnan et al. | 704/225 |
| 8,165,128 | B2 * | 4/2012 | Sun et al. | 370/394 |
| 8,195,465 | B2 * | 6/2012 | Zopf et al. | 704/267 |
| 2004/0001705 | A1 * | 1/2004 | Soupliotis et al. | 386/117 |
| 2004/0120309 | A1 * | 6/2004 | Kurittu et al. | 370/352 |
| 2008/0046249 | A1 * | 2/2008 | Thyssen et al. | 704/262 |
| 2008/0046252 | A1 | 2/2008 | Zopf et al. | |

OTHER PUBLICATIONS

Perkins, et al., "A Survey of Packet Loss Recovery Techniques for Streaming Audio", IEEE Network Magazine, (Sep./Oct. 1998), pp. 40-48.

Watkins, et al., "Improving 16 kb/s G.728 LD-CELP Speech Coder for Frame Erasure Channels", ICASSP, (May 1995), pp. 241-244.

Salami, et al., "Design and Description of CS-ACELP: a Toll Quality 8 kb/s Speech Coder", IEEE Trans. Speech and Audio Processing, vol. 6, No. 2, (Mar. 1998), pp. 116-130.

Chen, "Packet Loss Concealment for Predictive Speech Coding Based on Extrapolation of Speech Waveform", ACSSC 2007, (Nov. 2007), pp. 2088-2092.

Chen, "Packet loss concealment based on extrapolation of speech waveform", ICASSP 2009, (Apr. 2009), pp. 4129-4132.

Aoki, et al., "Development of a VoIP System Implementing a High Quality Packet Loss Concealment Technique", Canadian Conference on Electrical and Computer Engineering, (May 2005), pp. 308-311.

Zopf, et al., "Time-Warping and Re-Phasing in Packet Loss Concealment", Proc. Interspeech 2007—Eurospeech, Antwerp, Belgium, (Aug. 27-31, 2007), pp. 1677-1680.

ITU-T, "G.711, Appendix I: A High Quality Low-complexity Algorithm for Packet Loss Concealment with G.711", (1999), 26 pages.

* cited by examiner

*Primary Examiner* — Talivaldi Ivars Smits
(74) *Attorney, Agent, or Firm* — Fiala & Weaver P.L.L.C.

(57) ABSTRACT

Packet loss concealment (PLC) systems and methods are described that use time-warping to merge a concealment signal generated to replace one or more bad frames of an audio signal with a received signal representing one or more subsequent good frames of the audio signal in a manner that avoids signal discontinuity and audible artifacts resulting therefrom. Prediction-based PLC systems and methods are also described that use time-warping to conceal the loss of one or more frames containing a transition region in a manner that will not result in an audible artifact.

27 Claims, 14 Drawing Sheets

TIME-WARPING OF AUDIO SIGNALS FOR PACKET LOSS CONCEALMENT AVOIDING AUDIBLE ARTIFACTS

BACKGROUND OF THE INVENTION

1. Field of the Invention

The present invention relates to digital communications systems. More particularly, the present invention relates to the enhancement of audio quality when portions of an encoded bit stream representing an audio signal, such as a speech signal, are lost within the context of a digital communications system.

2. Background

In speech coding (sometimes called "voice compression"), a coder encodes an input speech signal into a digital bit stream for transmission. A decoder decodes the bit stream into an output speech signal. The combination of the coder and the decoder is called a codec. The transmitted bit stream is usually partitioned into segments called frames, and in packet transmission networks, each transmitted packet may contain one or more frames of a compressed bit stream. In wireless or packet networks, sometimes the transmitted frames or packets are erased or lost. This condition is typically called frame erasure in wireless networks and packet loss in packet networks. When this condition occurs, to avoid substantial degradation in output speech quality, the decoder needs to perform frame erasure concealment (FEC) or packet loss concealment (PLC) to try to conceal or otherwise mitigate the quality-degrading effects of the lost frames. Because the terms FEC and PLC generally refer to the same kind of technique, they can be used interchangeably. Thus, for the sake of convenience, the term "packet loss concealment," or PLC, will be used herein to refer to both.

A number of PLC techniques have been developed. These techniques can be broadly classified into sender-based or receiver-based approaches. (See, C. Perkins, et al., "A Survey of Packet Loss Recovery Techniques for Streaming Audio," IEEE Network Magazine, pp. 40-48, September/October 1998). Some PLC schemes may consist of varying mixtures of the two classes. Sender-based PLC schemes require modifications to a transmitter and are generally based on the transmission of redundant information or the use of interleaving. Receiver-based PLC schemes are confined to a receiver and attempt to mitigate the effects of a lost frame by utilizing the speech signal in neighboring received frames.

At the receiver, the mitigation problem is either one of prediction or estimation. In the case of prediction, the PLC scheme uses only portions of a speech signal that precede one or more lost frames (also referred to herein as "past speech" or "past frames") to "predict" the speech signal in the lost frame(s). Portions of the speech signal that follow the lost frame(s) (also referred to herein as "future speech" or "future frames") are not used. In the case of estimation, however, both the past speech and future speech are available and are used to "estimate" the speech signal in the lost frame(s). In certain cases, future frames are obtained through the use of a jitter buffer. Rather than directly playing out the speech samples carried by packets as they arrive at the receiver, a jitter buffer holds the speech samples for a period of time. The amount of delay added by the jitter buffer is often based on the monitored arrival time of packets from the transmitter. A PLC scheme that uses a jitter buffer may employ some form of time-scale modification in the playback of the speech signal in order to increase or reduce the amount of data in the jitter buffer and to adapt to dynamic network delay conditions.

A popular method for PLC is based on periodic waveform extrapolation (PWE). In PWE, the missing data is concealed by repeating a pitch signal based on the pitch period of a neighboring speech signal. PWE may be performed in either the excitation domain (see, e.g., C. R. Watkins and J.-H. Chen, "Improving 16 kb/s G.728 LD-CELP Speech Coder for Frame Erasure Channels," ICASSP, pp. 241-244, May 1995; R. Salami, et al., "Design and Description of CS-ACELP: a Toll Quality 8 kb/s Speech Coder," IEEE Trans. Speech and Audio Processing, Vol. 6, No. 2, pp. 116-130, March 1998) or the speech domain (see, e.g., J.-H. Chen, "Packet Loss Concealment for Predictive Speech Coding Based on Extrapolation of Speech Waveform," ACSSC 2007, pp. 2088-2092, November 2007; J.-H. Chen, "Packet loss concealment based on extrapolation of speech waveform," ICASSP 2009, pp. 4129-4132, April 2009). A major challenge associated with PWE is avoiding signal discontinuity in the transition between the concealment waveform and the received speech signal. In excitation domain PWE, any signal discontinuity is mostly smoothed out by synthesis filtering. In speech domain PWE, an overlap-add is typically used to perform smoothing. In particular, in the first good frame after frame loss, the extrapolated signal is extended into a first portion of the received signal and used in the overlap-add operation. In the transition from concealment waveform to received speech, a delay may be used to enable the overlap-add. (See, ITU-T, "G.711, Appendix I: A High Quality Low-complexity Algorithm for Packet Loss Concealment with G.711," 1999). The additional delay associated with this scheme may be circumvented by utilizing the "ringing" of a synthesis filter. (See, J.-H. Chen, "Packet Loss Concealment for Predictive Speech Coding Based on Extrapolation of Speech Waveform," ACSSC 2007, pp. 2088-2092, November 2007).

It has been reported that most of the distortion associated with PLC is not from the lost frames, but from the frames after packet loss, often due to misalignment between the extrapolated waveform and the received signal. (See J.-H. Chen, "Packet loss concealment based on extrapolation of speech waveform," ICASSP 2009, pp. 4129-4132, April 2009). As discussed above, to avoid discontinuity, the PWE waveform can be extended beyond the end of the lost frame and an overlap-add operation with the first good frame after packet loss can then be performed. However, the true pitch period of the lost frame(s) in general does not follow the pitch track used during the waveform extrapolation. As a result, the extrapolated signal and the speech signal in the first good frame may be out of phase and destructive interference can occur in the overlap-add region causing an audible distortion.

Different estimation techniques have been proposed in the literature to combat the issue of phase alignment of the extrapolated signal and the received speech signal. For example, one technique performs interpolation between the previous good frame(s) and future good frame(s) on either side of the packet loss. (See N. Aoki, et. al. "Development of a VoIP System Implementing a High Quality Packet Loss Concealment Technique", Canadian Conference on Electrical and Computer Engineering, pp. 308-311, May 2005). However, doing so requires the extraction of the pitch period of the speech segment after the packet loss, which in turn requires a long segment of decoded speech after the packet loss to be available. Typically, 25 to 35 milliseconds (ms) of decoded speech must be buffered. In another technique, the PLC algorithm uses the decoded speech waveform associated with a future frame to guide the pitch contour of waveform extrapolation during the lost frame such that the extrapolated waveform is phase-aligned with the decoded speech waveform after the packet loss. (See J.-H. Chen, "Packet loss concealment based on extrapolation of speech waveform," ICASSP 2009, pp. 4129-4132, April 2009). This technique also requires future frame(s) to be buffered, but since the pitch period is not explicitly estimated in the future speech, the delay requirement is reduced.

The estimation methods above introduce delay, requiring speech to be buffered at the receiver. In R. Zopf, J. Thyssen, and J.-H. Chen, "Time-Warping and Re-Phasing in Packet Loss Concealment," Proc. Interspeech 2007—Eurospeech, pp. 1677-1680, Antwerp, Belgium, Aug. 27-31, 2007, time-warping is used to stretch or shrink the time axis of the signal received in the first good frame after frame loss to align it with the extrapolated signal used to conceal the lost frame. This prediction technique avoids the introduction of additional delay by modifying the received signal after packet loss as opposed to modifying the extrapolation signal during packet loss.

The above techniques have drawbacks and limitations. The estimation techniques require frame(s) to be buffered at the decoder, thus introducing additional delay. This is a fixed delay introduced into the system regardless of network conditions. Even in perfect network conditions with no packet loss, additional delay has be introduced. The two-sided estimation technique presented in the reference by N. Aoki, et. al. does not work when the pitch variation in the missing speech segment is not linear. This is illustrated in FIGS. 1A and 1B. In particular, FIG. 1A shows the pitch cycle phase associated with three frames of a speech signal as a function of time, wherein the second frame is lost. The three frames are designated "last good frame," "current bad frame" and "next good frame," respectively. The various pitch periods associated with the speech signal across the three frames are shown as $p_0$, $p_1$ and $p_2$, wherein $p_2>p_1>p_0$. As shown in FIG. 1A, during the lost frame, the pitch period slowly increases and decreases. FIG. 1B shows that when the two-sided estimation technique is applied to replace the lost frame shown in FIG. 1A, the result is the creation of two out-of-phase waveforms. In particular, the technique results in the extrapolation of a first waveform 102 based on the last good frame and the extrapolation of second waveform 104 based on the next good frame, wherein first waveform 102 and second waveform 104 are out of phase. In further accordance with the two-side estimation technique, the two out-of-phase waveforms are combined using an overlap-add operation, which results in destructive interference.

All of the techniques described above have a limited amount of time for the phase adjustment. For estimation approaches that provide a one-frame look-ahead, the phase adjustment must be achieved within the length of the lost frame. In the case of the approach presented in the aforementioned reference entitled "Time-Warping and Re-Phasing in Packet Loss Concealment," the time-warping is applied only within the length of the first good frame. Hence, in these approaches, the phase adjustment must be achieved within a single frame. This should be sufficient in the case of isolated frame loss where only a single frame is missing. However, for consecutive frame loss, the natural phase evolution that has occurred over the period of multiple frames must now be applied in a single frame. In fact, it was noted in the aforementioned reference entitled "Time-Warping and Re-Phasing in Packet Loss Concealment" that the amount of time-warping was tuned to be constrained to ±1.75 milliseconds (ms) for 10 ms frames. Time-warping by more than this may remove the destructive interference, but often introduces some other audible distortion.

The foregoing problem is illustrated in FIG. 2. In particular, FIG. 2 shows the pitch cycle phase associated with three frames of a speech signal 202 as a function of time, wherein the first and second frames are lost and the third frame represents the first good frame after the lost frames. The three frames are designated "first bad frame," "second bad frame" and "first good frame," respectively. In accordance with this scenario, an estimation solution that provides a one-frame look-ahead becomes one of prediction because both the first and second frames are lost. Since the speech signal is not known in the second bad frame, the first bad frame must be extrapolated using the pitch from only the last good frame. If the third frame is also lost, the second bad frame must be extrapolated again using the same pitch.

As shown in FIG. 2, the pitch period associated with speech signal 202 slowly increases during the three frames. In contrast, during the lost frames, an extrapolated waveform 204 generated to replace the lost frames has a fixed pitch period that is based on a previous good frame. Consequently, the phases of speech signal 202 and extrapolated waveform 204 diverge. In particular, by the end of the second bad frame, extrapolated waveform 204 and speech signal 202 are 180 degrees out of phase. This phase misalignment must be corrected in the first good frame by generating a waveform 206 exhibiting unnatural phase evolution. Adjustment of the phase by this amount in a limited amount of time may introduce an audible distortion.

What is needed then is an approach to performing PLC that operates to merge an extrapolated signal generated to replace one or more lost frames of an audio signal with a received signal representing one or more subsequent good frames of the audio signal in a manner that avoids signal discontinuity and audible artifacts resulting therefrom. The desired approach should operate to align the phase of the extrapolated signal and the received signal in a manner that does not require the introduction of a fixed delay as required by estimation-based PLC schemes. The desired approach should also overcome the constraints associates with prediction-based PLC schemes that utilize time-warping and require the entirety of the phase adjustment to be achieved within the first good frame.

Another major source of distortion associated with PLC is the loss of one or more frames that include transitions, such as transitions from unvoiced to voiced sounds, from voiced to unvoiced sounds, and from one voice sound to another voiced sound. Loss of the frame(s) containing the transition region will often result in an audible artifact during PLC if the transition is not handled carefully. For estimation PLC where the future frames are buffered before playback, classification of the frames before and after the packet loss can be done and the transition can be detected and estimated accordingly. The problem occurs in prediction-based PLC when only the past speech is available. In this case, the upcoming transition is not known or very difficult to accurately predict. The prediction-based PLC scheme may conceal the transition with the previous signal type and then perform an overlap-add of the different signals in the first good frame. Unfortunately, the overlap-add of these different signals does not accurately reproduce the transition region and an audible artifact often results. What is also needed, then, is an approach to perform prediction-based PLC that can conceal the loss of one or more frames containing a transition region in a manner that will not result in an audible artifact.

BRIEF SUMMARY OF THE INVENTION

Packet loss concealment (PLC) systems and methods are described herein that may advantageously be used to merge a concealment signal generated to replace one or more bad frames of an audio signal with a received signal representing one or more subsequent good frames of the audio signal in a manner that avoids signal discontinuity and audible artifacts resulting therefrom. Embodiments of the system and method operate to align the phase of the concealment signal and the received signal in a manner that does not require the introduction of a fixed delay as required by estimation-based PLC schemes. Embodiments of the system and method also overcome the constraints associates with prediction-based PLC schemes that utilize time-warping and require the entirety of the phase adjustment to be achieved within the first good frame.

Systems and methods are also described herein that are capable of performing prediction-based PLC to conceal the loss of one or more frames containing a transition region in a manner that will not result in an audible artifact.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 5A:
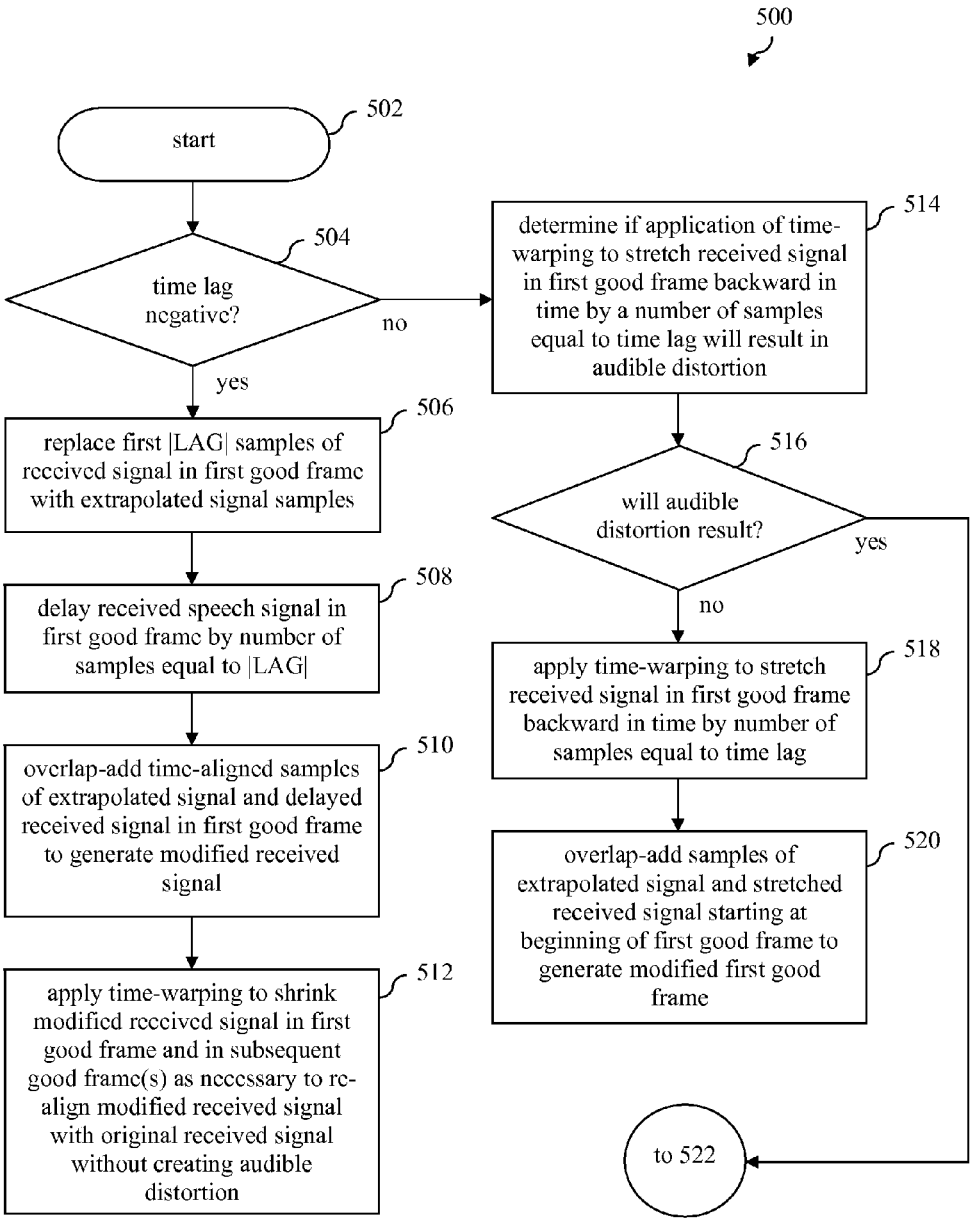
Figure 5B:
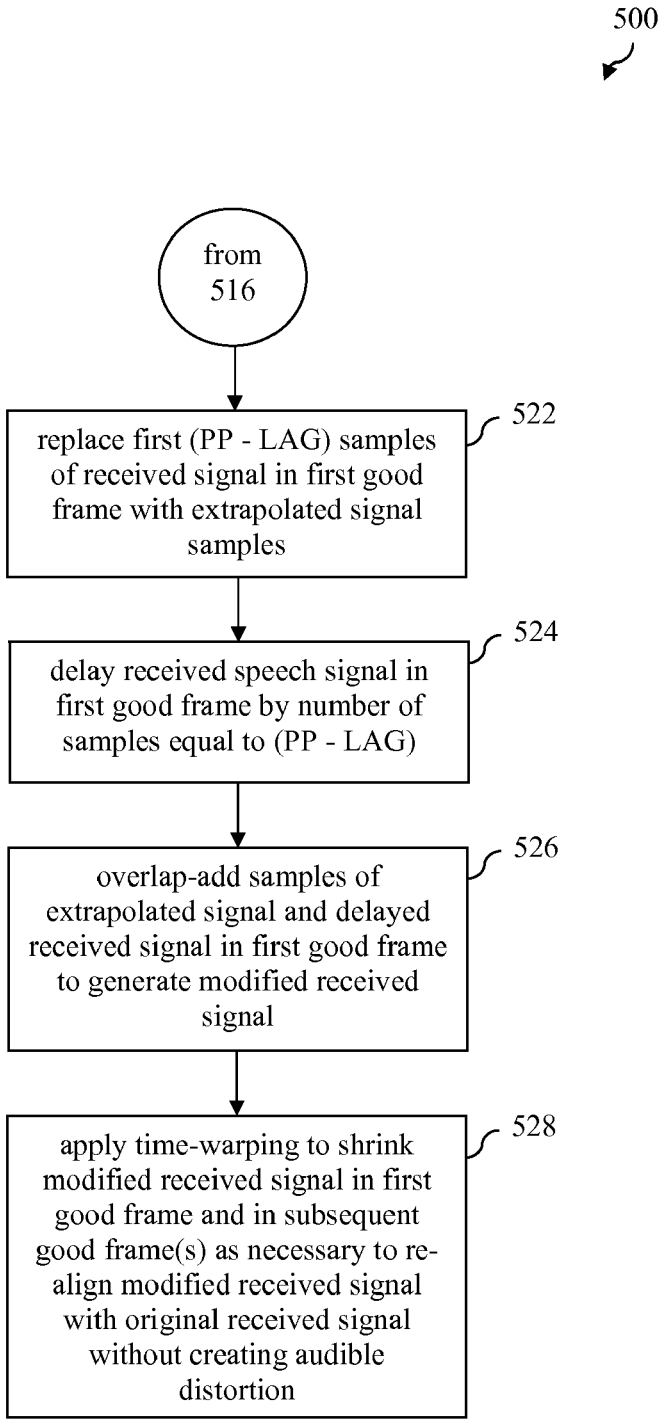

FIGS. 5A and 5B collectively depict a flowchart of a method for applying time-warping to merge an extrapolated signal generated to replace one or more bad frames of an audio signal with a received signal associated with one or more good frames of the audio signal received after the bad frame(s) in accordance with an embodiment of the present invention.

Figure 6:
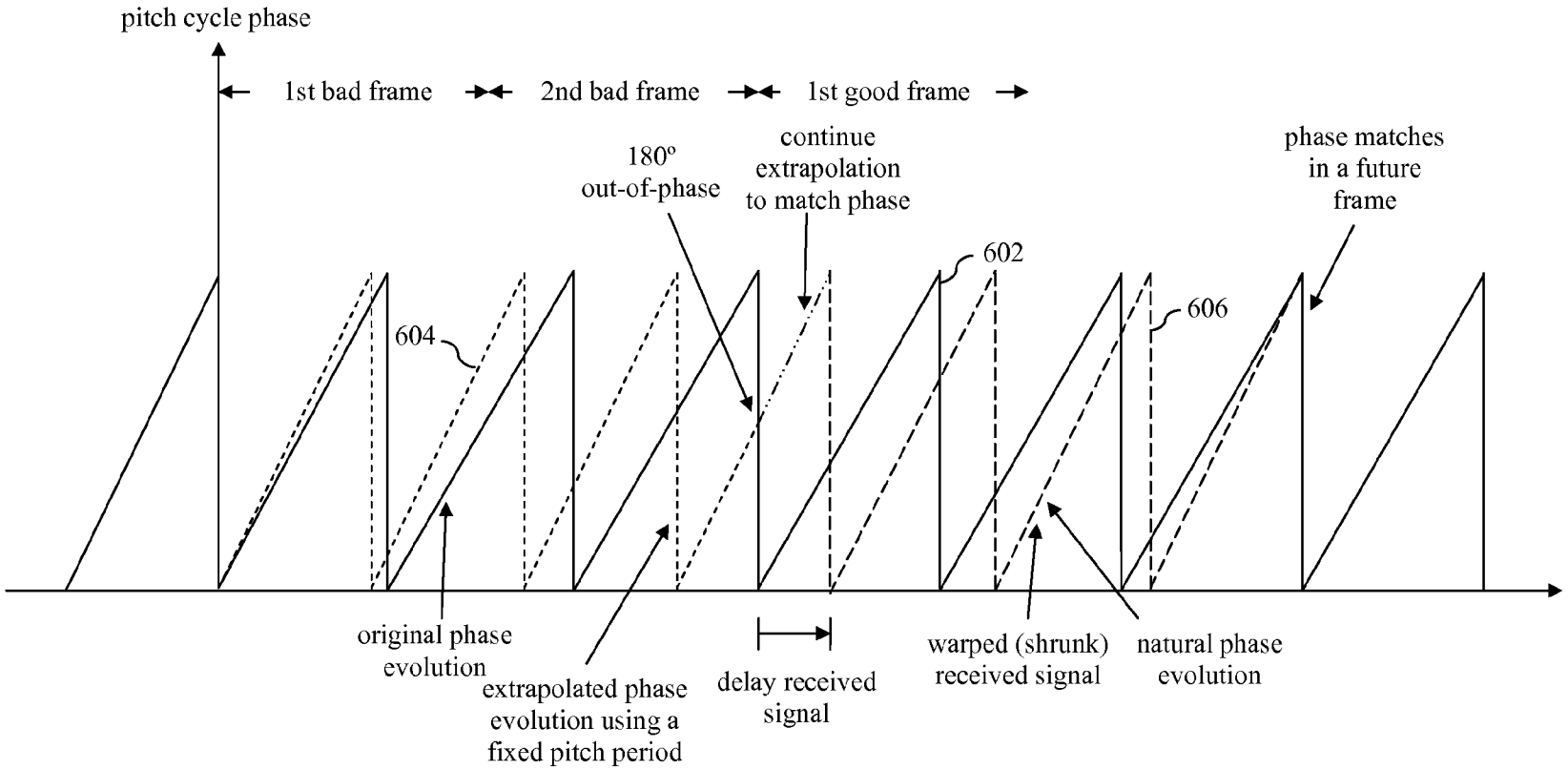

FIG. 6 is a diagram that illustrates the application of the method of the flowchart of FIG. 5 in a scenario in which the extrapolated signal lags the received signal in the first good frame.

Figure 7:
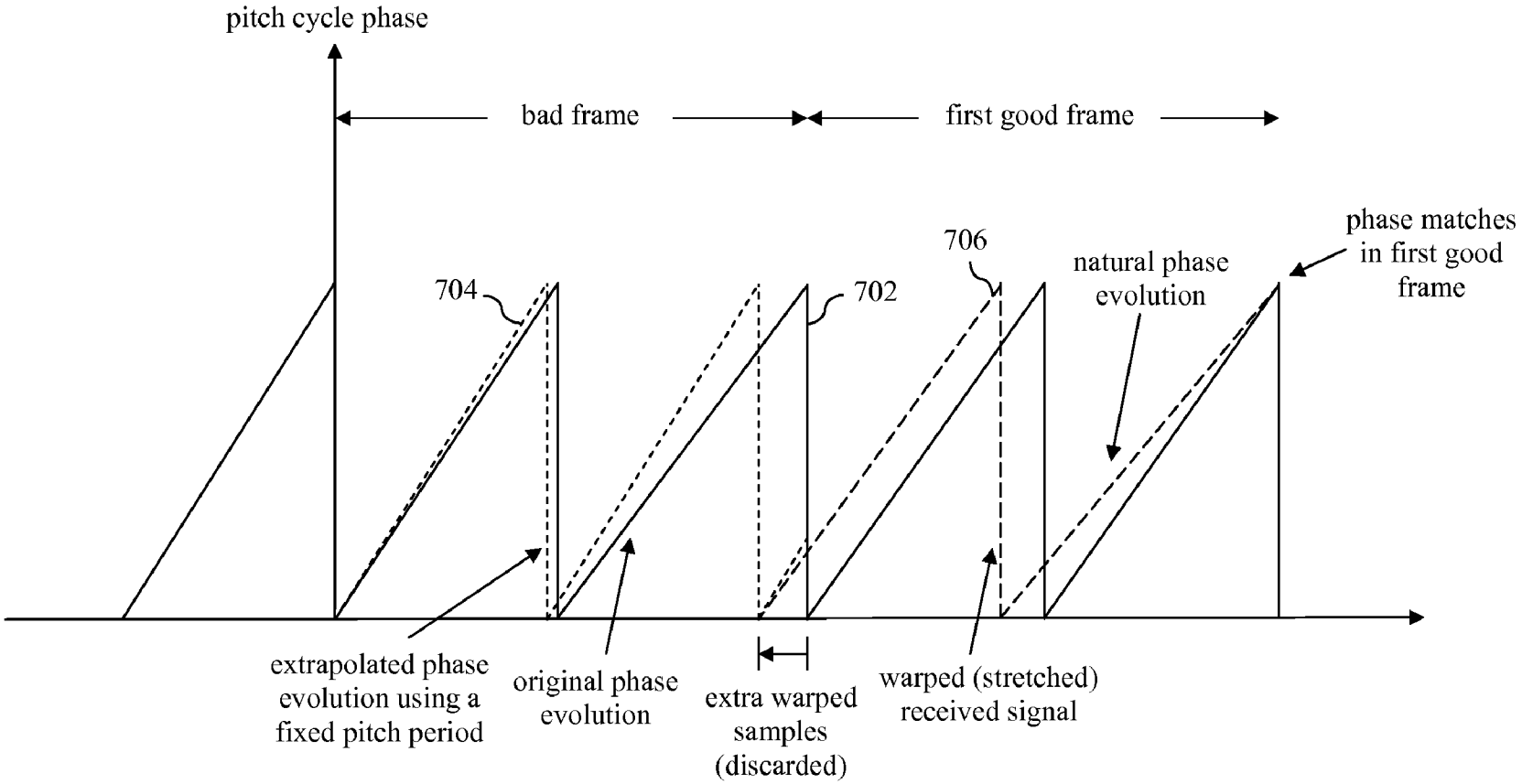

FIG. 7 is a diagram that illustrates the application of the method of the flowchart of FIG. 5 in a scenario in which the extrapolated signal leads the received signal in the first good frame and the application of time-domain stretching to align the signals will not result in an audible artifact.

Figure 8:
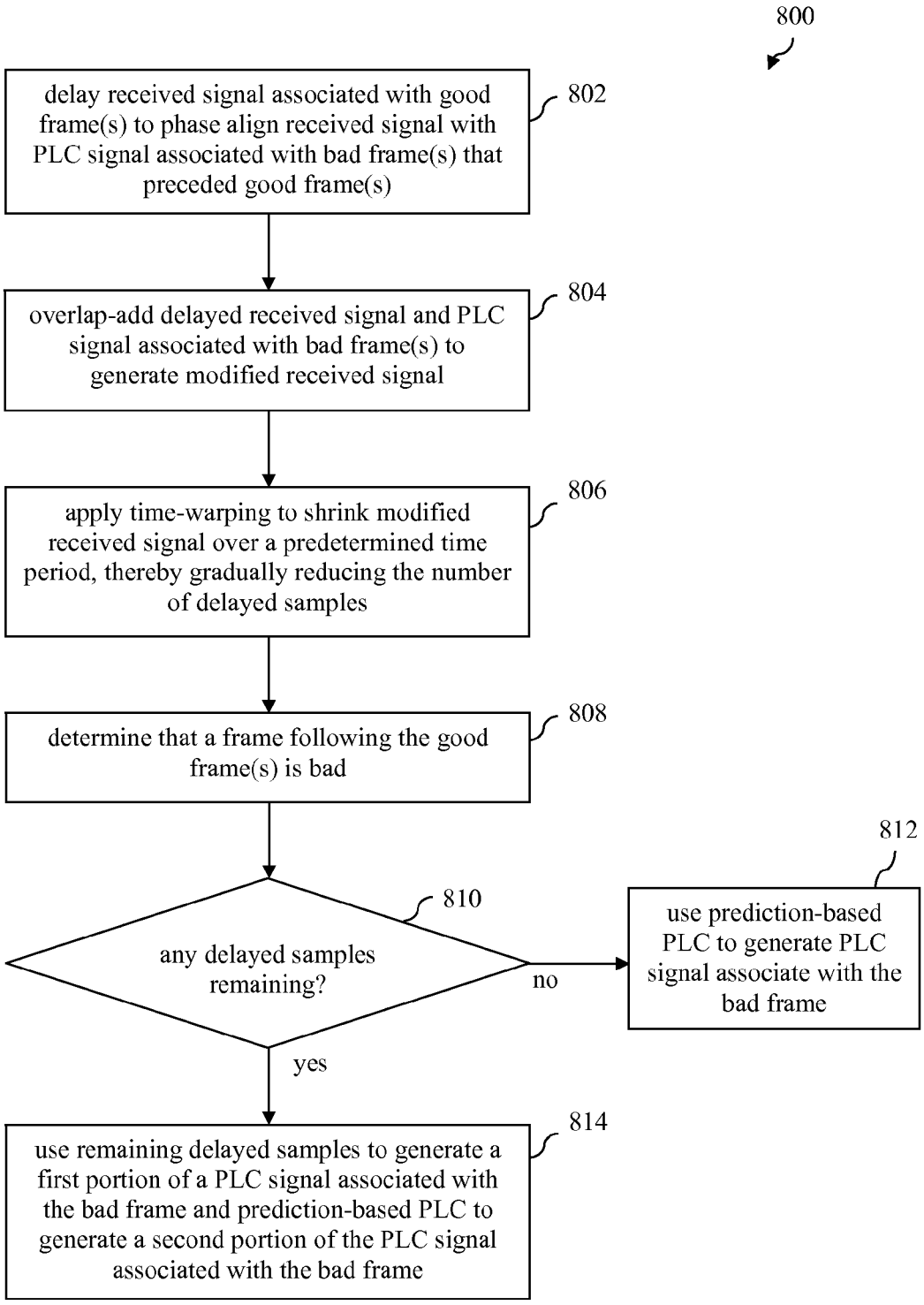

FIG. 8 is a flowchart of a method for using delayed samples generated in accordance with the method of the flowchart of FIG. 5 to reduce the duration of a subsequent period of packet loss.

Figure 9:
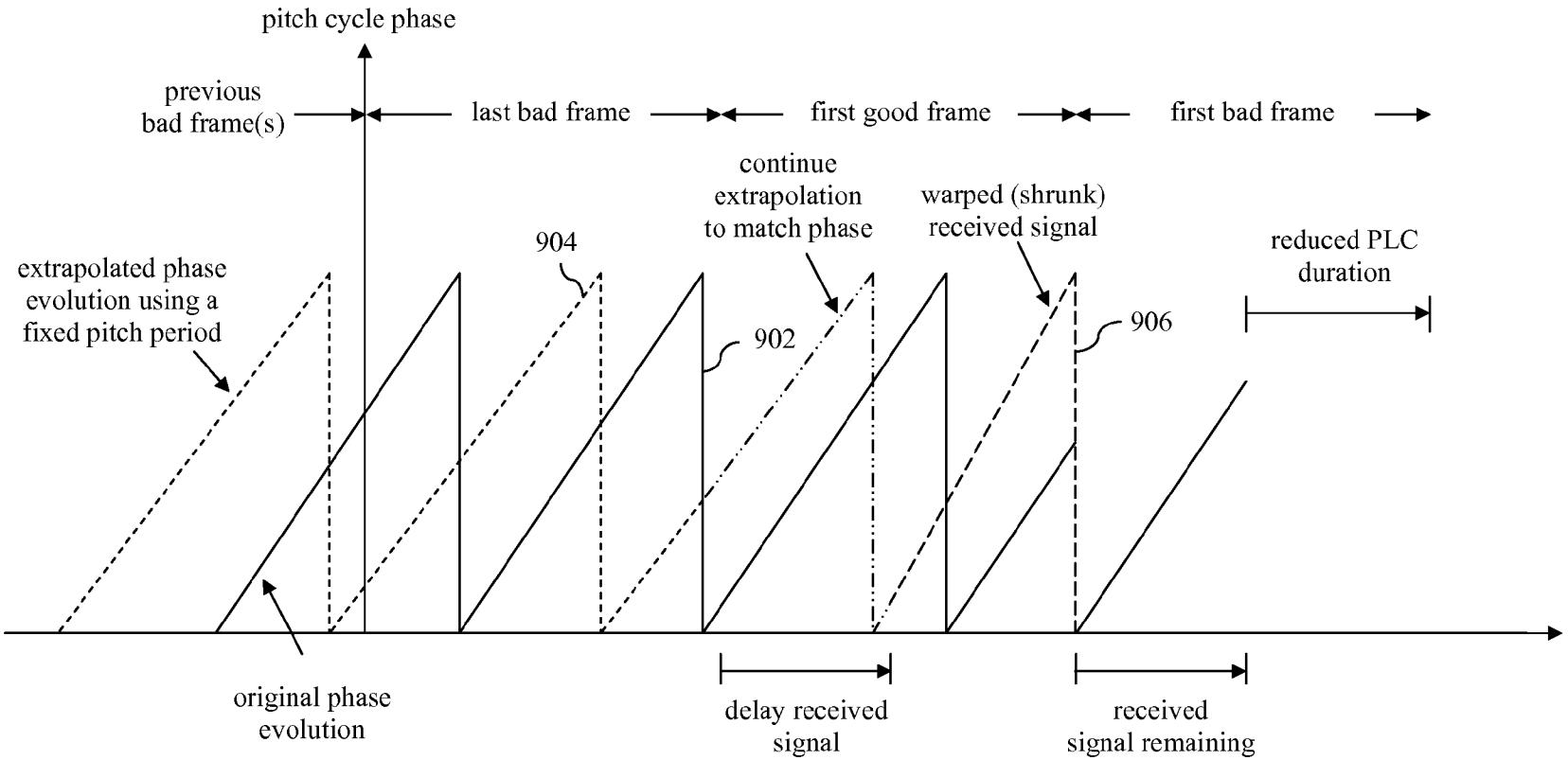

FIG. 9 is a diagram illustrating the application of the flowchart of FIG. 8.

Figure 10:
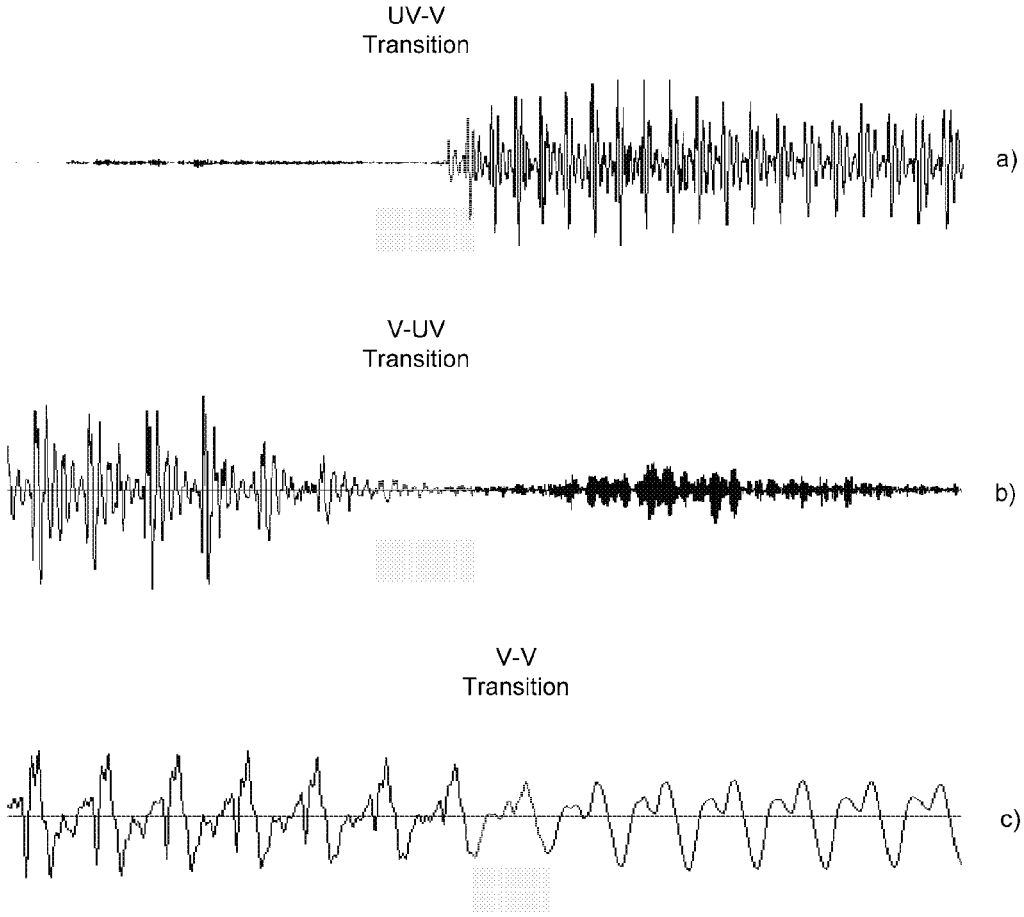

FIG. 10 illustrates three audio waveforms demonstrating an unvoiced to voiced transition, a voiced to unvoiced transition, and a transition from one voiced sound to another, respectively.

Figure 11:
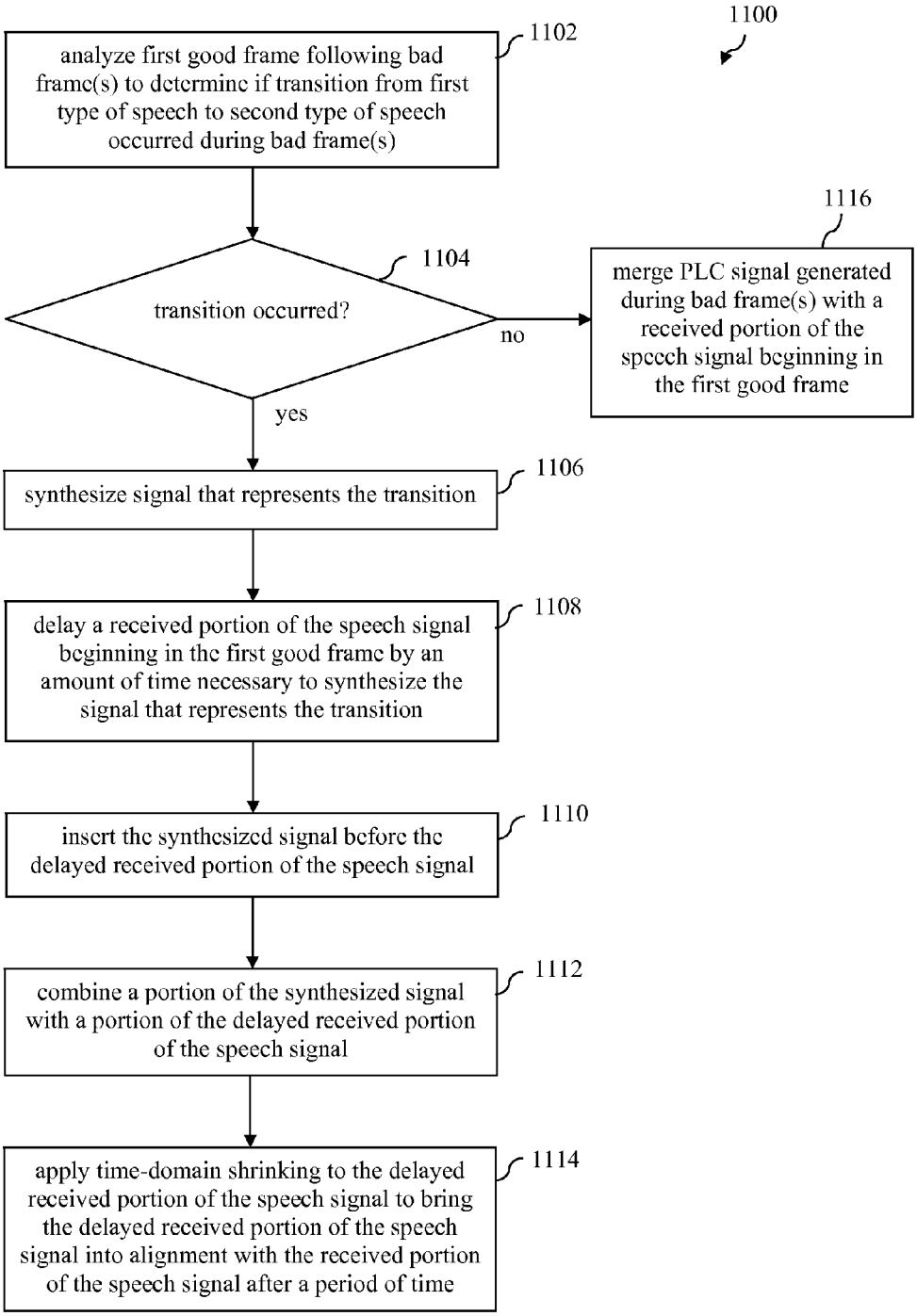

FIG. 11 depicts a flowchart of a method for improved handling of transitions in prediction-based PLC.

Figure 12:
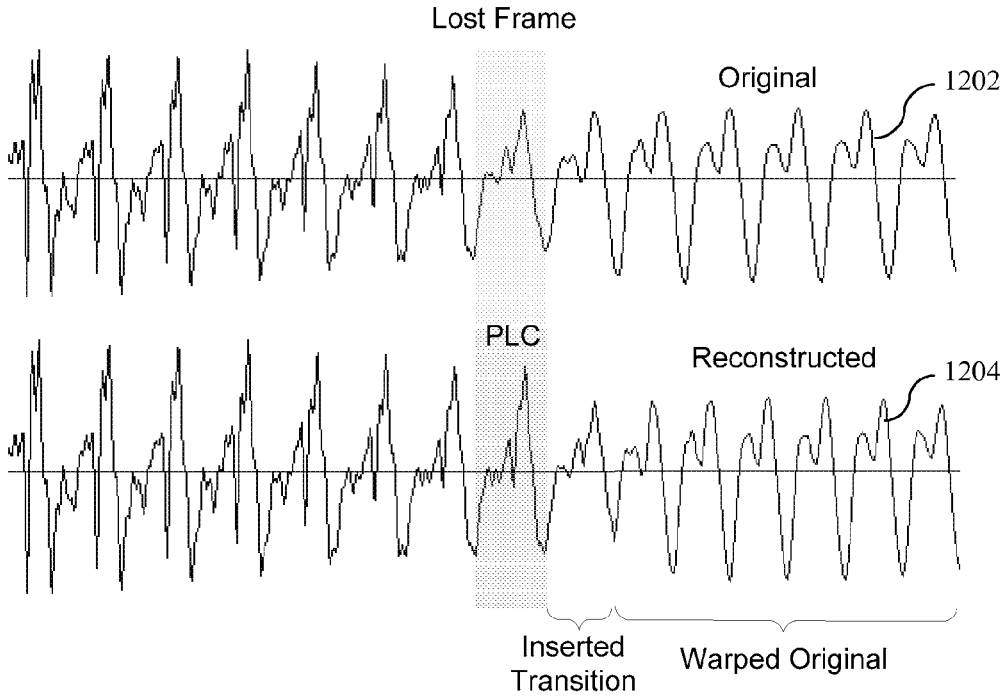

FIG. 12 is a diagram illustrating the application of the flowchart of FIG. 11.

Figure 13:
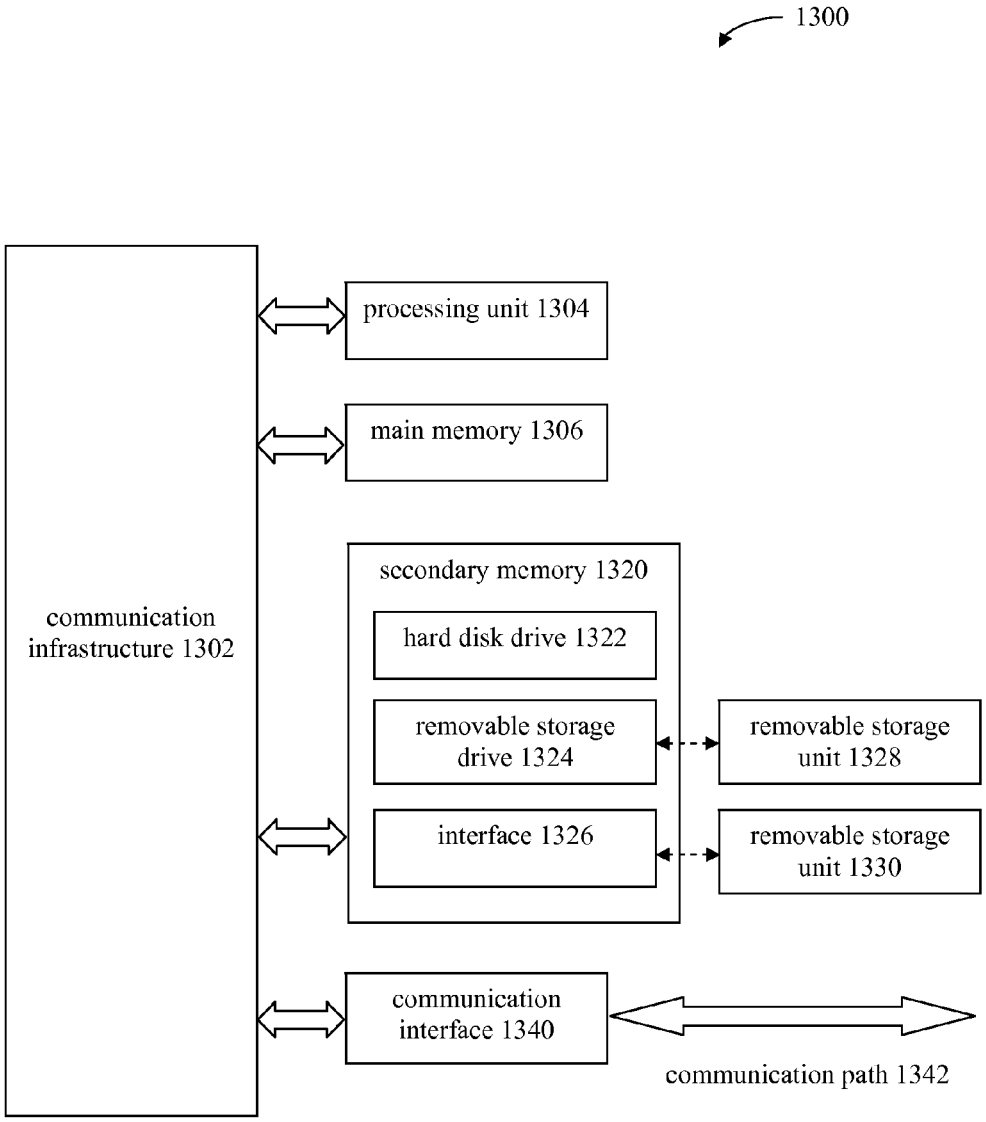

FIG. 13 is a block diagram of an example computer system that may be used to implement aspects of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

B. Example Operating Environment

Figure 3:
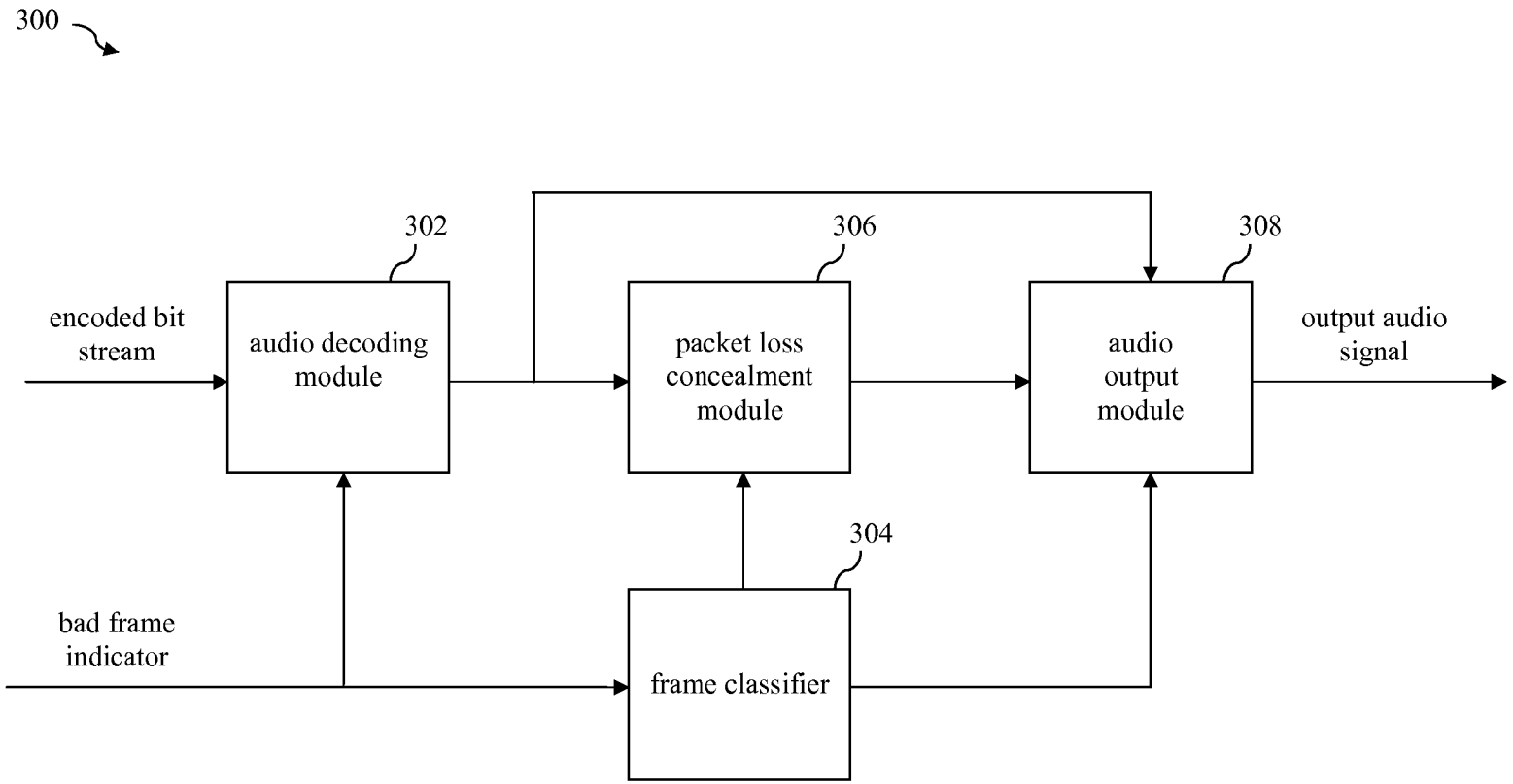
FIG. 3 is a block diagram of an example system that may implement aspects of the present invention.

FIG. 3 illustrates an example system 300 that may implement aspects of the present invention. In one embodiment, system 300 comprises part of a receiver in a digital communications system, the receiver being configured to receive an encoded bit stream from a transmitter and process the encoded bit stream to generate an output audio signal for playback to a user. However, this example is not intended to be limiting, and system 300 may generally represent any type of system that is capable of processing an encoded bit stream to generate an output audio signal therefrom for any purpose whatsoever.

As shown in FIG. 3, system 300 includes a number of interconnected components including an audio decoding module 302, a frame classifier 304, a packet loss concealment (PLC) module 306 and an audio output module 308. The operation of each of these components will be described below. Depending upon the implementation, each of these components may be implemented in hardware using analog and/or digital circuits, in software, through the execution of instructions by one or more general purpose or special-purpose processors, in firmware, or in any combination of hardware, software or firmware.

Audio decoding module 302 is configured to receive and process an encoded bit stream that represents a compressed version of an audio signal to generate a decoded or decompressed audio signal therefrom. Audio decoding module 302 operates on serially-received segments of the encoded bit stream, which may be referred to as frames, to produce corresponding segments of the decoded audio signal, which may also be referred to as frames. In an embodiment in which system 300 comprises a part of a receiver in a digital communications system, the frames of the encoded bit stream may be received from a demodulator/channel decoder incorporated within the receiver. The demodulator/channel decoder may be configured to demodulate a modulated carrier signal received over a communication medium to produce the frames of the encoded bit stream.

Audio decoding module 302 essentially operates to undo an encoding applied to frames of an audio signal to compress the audio signal prior to delivery to system 300. Depending upon the implementation, audio decoding module 302 may comprise any of a wide variety of well-known audio decoder types, including but not limited to decoders with and without memory, predictive and non-predictive decoders, and sub-band and full-band decoders. Frames of the decoded speech signal produced by audio decoding module 302 are output to PLC module 306 and audio output module 308.

Figure 1A:
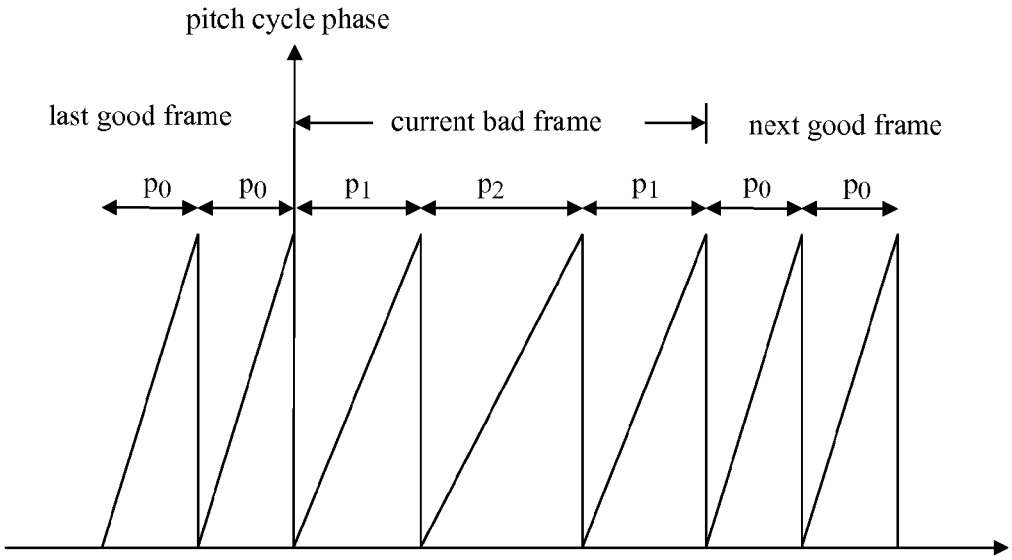
FIGS. 1A and 1B are diagrams that illustrate limitations associated with a two-sided extrapolation approach to packet loss concealment (PLC).
Figure 1B:
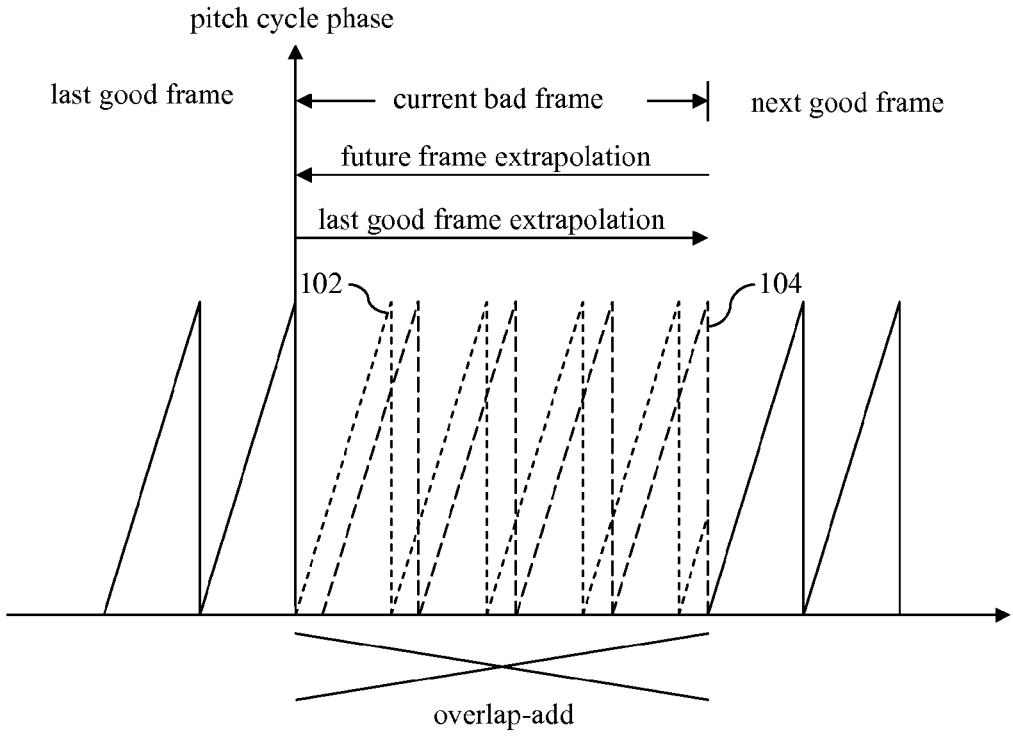

As shown in FIG. 1, audio decoding module 302 also receives as input a bad frame indicator. The bad frame indicator indicates whether or not a frame of the encoded bit stream to be received by audio decoding module 302 is a bad frame or a good frame. As used herein, the term "bad frame" refers to a frame of the encoded bit stream that is deemed lost or otherwise unsuitable for normal decoding operations while the term "good frame" refers to a frame of the encoded bit stream that has been received and is suitable for normal decoding operations. In an embodiment in which system 300 comprises a receiver, the bad frame indicator may be received from a demodulator/channel decoder or other component incorporated within the receiver. If the bad frame indicator indicates that a frame of the encoded bit stream to be received by audio decoding module 302 is bad, audio decoding module 302 will not decode the frame. Otherwise, audio decoding module 302 will decode the frame.

Frame classifier 304 is configured to receive the bad frame indicator associated with each frame of the encoded bit stream and to classify each frame based upon the state or value of the bad frame indicator associated therewith and, if applicable, upon a classification applied to one or more previously-processed frames. The frame type associated with each frame is provided to PLC module 306, which uses such information to determine whether or not to perform PLC operations in a manner to be described in more detail herein. At a minimum frame classifier 304 classifies each frame into at least one of three frame types: (a) bad frame; (b) first good frame after a series of one or more bad frames; or (c) good frame that is not the first good frame after one or more bad frames. As will be appreciated by persons skilled in the relevant art(s), more complex classification schemes may be applied, including schemes that provide additional frame types or that subdivide the above-listed frame types into further frame types. One example of a more complex frame classification scheme that may be used in conjunction with a G.722 decoder and that distinguishes between the above-listed frame types is described in commonly-owned, co-pending U.S. patent application Ser. No. 11/838,908, filed Aug. 15, 2007, the entirety of which is incorporated by reference herein.

PLC module 306 is configured to perform operations that are intended to conceal or otherwise mitigate the effect of bad frames with respect to the quality of the output audio signal produced by system 300. In particular, if frame classifier 304 indicates that a particular frame of the encoded bit stream is bad, PLC module 306 generates a concealment signal that is used by audio output module 308 to replace the decoded signal that would have been produced by audio decoding module 302 if the frame had been deemed good. In one embodiment, PLC module 306 uses a prediction-based PLC technique that includes performing periodic waveform extrapolation (PWE) on previously-decoded frames received from audio decoding module 302 to generate at least some of the replacement frames. However, the invention is not so limited and PLC module 306 may use methods other than PWE to generate the replacement frames. Thus, although reference will be made herein to an "extrapolated signal" produced by PLC module 306, persons skilled in the art will appreciate that other types of concealment signals may be produced by PLC module 306.

PLC module 306 also performs operations during one or more good frames received after a series of one or more bad frames to avoid potential discontinuity between an extrapolated signal generated to replace the bad frame(s) and a received signal associated with the good frame(s). In particular, if frame classifier 304 indicates that a particular frame of the encoded bit stream is a first good frame after one or more bad frames, PLC module 306 will extend the extrapolated signal into the first good frame and perform an overlap-add operation between the extrapolated signal and the received signal in the first good frame. Also, as will be described in more detail herein, if PLC module 306 determines that there is a phase misalignment between the extrapolated signal and the received signal in the first good frame, PLC module 306 will apply time-warping to the received signal either prior to or after performing an overlap-add operation between the extrapolated signal and the received signal to account for the misalignment, wherein time-warping refers to stretching or shrinking the received signal in the time domain. Depending upon the scenario, the time-warping may be limited to the first good frame or extend into subsequent good frames. Particular details involved in performing the time-warping and overlap-add operations will be set forth in Section C, below. After modifying the received signal in the good frame(s), PLC module provides the replacement frames to audio output module 308 for use in generating an output audio signal.

Audio output module 308 is configured to receive decoded frames from audio decoding module 302 and replacement frames from PLC module 306 and to use such frames to generate an output audio signal. Generation of an output audio signal may include, for example, converting frames comprising a series of digital samples into an analog form as well as performing other functions. The output audio signal may be provided to one or more speakers for playback to a user or may be provided to other components for use in other applications.

Figure 4:
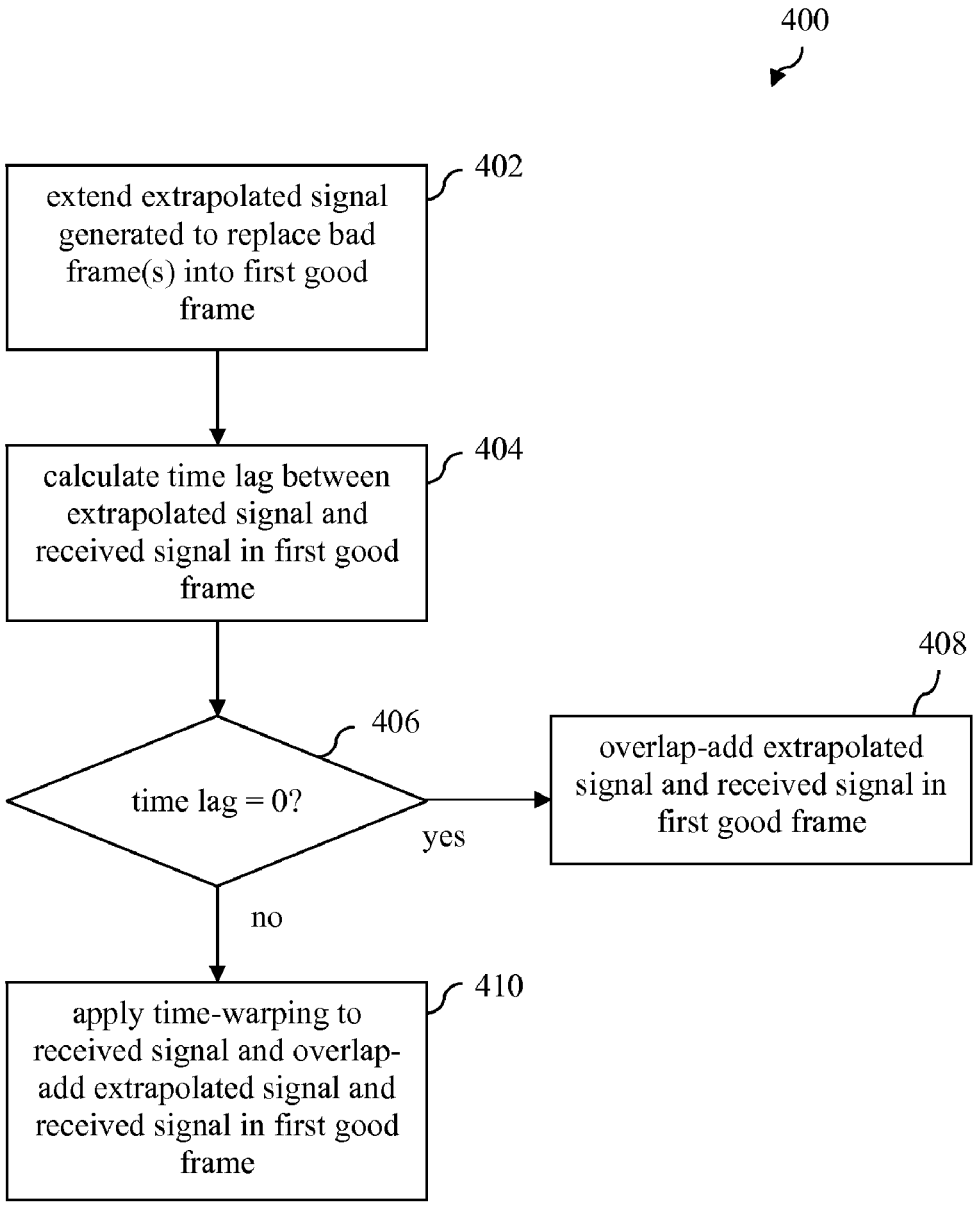
FIG. 4 depicts a flowchart of a method for merging an extrapolated signal generated to replace one or more bad frames of an audio signal with a received signal associated with one or more good frames of the audio signal received after the bad frame(s) in accordance with an embodiment of the present invention.

C. Time-Warped Packet Loss Concealment for Eliminating Phase Misalignment in Accordance with Embodiments of the Present Invention FIG. 4 depicts a flowchart 400 of a method for transitioning between an extrapolated signal generated to replace one or more bad frames and a received signal associated with one or more good frames received after the bad frame(s) in accordance with an embodiment of the present invention. Although the method of flowchart 400 will be described herein in reference to components of example system 300 as described above in reference to FIG. 3, persons skilled in the relevant art(s) will appreciate that the method is not so limited, and may be performed by other components or systems.

In an embodiment, the method of flowchart 400 is performed by PLC module 306 responsive to receiving an indication from frame classifier 304 that a frame of the encoded bit stream received by system 300 corresponds to the first good frame after a series of one or more bad frames. As shown in FIG. 3, the method begins at step 402, in which PLC module 306 extends an extrapolated signal that was generated to replace the previous bad frame(s) into the first good frame. The extension of the extrapolated signal may be performed using the same PWE technique used to originally generate the extrapolated signal or some other technique.

At step 404, PLC module 306 calculates a time lag between the extrapolated signal and the received signal in the first good frame, wherein the time lag comprises a measure of phase misalignment between the extrapolated signal and the received signal. In one embodiment, the time lag is defined as the number samples by which the received signal is lagging the extrapolated signal. Thus, in accordance with this embodiment, the time lag will be negative when the received signal leads the extrapolated signal.

Various methods may be used to calculate the time lag. For example, commonly-owned, co-pending U.S. patent application Ser. No. 11/838,908, filed Aug. 15, 2007 (the entirety of which has been incorporated by reference herein), describes various methods for calculating a time lag between an extrapolated signal generated for PLC and a received signal. As described in that application, the time lag may be calculated by maximizing a correlation between the extrapolated signal and the received signal associated with the first good frame after packet loss. As also described in that application, the number of samples over which the correlation is computed may be determined in an adaptive manner based on the pitch period. Another technique described in that application includes performing a coarse time lag search using a down-sampled representation of the signals followed by performing a refined time lag search using a higher sampling rate representation of the signals in order to minimize the complexity of the correlation computation. Any of these techniques, as well as other techniques not described herein, may be used to perform step 404.

At decision step 406, PLC module 306 determines if the time lag calculated during step 404 is equal to zero. If the time lag is equal to zero, then PLC module 306 performs an overlap-add between the extrapolated signal and the received signal in the first good frame to mitigate the effect of any discontinuity between the two signals as shown at step 408. Such overlap-add may be performed, for example, at the beginning of the first good frame for a predetermined number of samples that define an overlap-add window. PLC module 306 does not apply time-warping to the received signal during step 408 since the zero time lag indicates that the two signals are already phase aligned. In alternative implementations, step 408 may be performed when the time lag is equal to zero and also when the time lag is greater than or less than zero but still deemed sufficiently small so as to be tolerable. Additionally, as described in commonly-owned, co-pending U.S. patent application Ser. No. 11/838,908, in certain implementations the time lag may be forced to zero if the last good frame before packet loss is deemed unvoiced and/or if the first good frame after packet loss is deemed unvoiced, since in these scenarios it may be assumed that the received signal is not periodic, and thus phase alignment is not a concern or simply cannot be achieved.

If PLC module 306 determines at decision step 406 that the time lag is not equal to zero, then PLC module 306 will apply time-warping to the received signal in at least the first good frame and will also perform an overlap-add between the extrapolated signal and the received signal (either prior to or after application of time-warping depending upon the scenario) in the first good frame as shown at step 410. The operations performed during step 410 are intended to phase align the extrapolated signal and the received signal in the first good frame such that destructive interference will be avoided when the two signals are overlap-added. As will be described in more detail below, unlike the time-warping scheme described in R. Zopf, J. Thyssen, and J.-H. Chen, "Time-Warping and Re-Phasing in Packet Loss Concealment," Proc. Interspeech 2007—Eurospeech, pp. 1677-1680, Antwerp, Belgium, Aug. 27-31, 2007 (and also described in U.S. patent application Ser. No. 11/838,908), the time-warping applied during step 410 is not necessarily limited to the received signal in the first good frame. Put another way, the point at which the phase of the time-warped signal re-converges with the phase of the original received signal is not necessarily restricted to occur within the first good frame. This enables the phase evolution of the time-warped signal to be maintained at a rate that is natural and inaudible.

FIGS. 5A and 5B collectively depict a flowchart 500 of one manner of performing step 410 of flowchart 400 in accordance with an embodiment of the present invention. As shown in FIG. 5A, the method of flowchart 500 begins at step 502, denoted "start." Control then flows to decision step 504, in which PLC module 306 determines if the time lag calculated during step 404 of flowchart 400 is negative.

If PLC module 306 determines during decision step 504 that the time lag is negative (i.e., the received signal leads the extrapolated signal), then steps 506, 508, 510 and 512 are performed to merge the extrapolated signal that was extended into the first good frame with the received signal. In particular, at step 506, PLC module 306 replaces the first |LAG| samples of the received signal in the first good frame with time-aligned samples from the extrapolated speech signal in the first good frame, wherein |LAG| represents the absolute value of the time lag. At step 508, PLC module 306 delays the received speech signal in the first good frame by a number of samples equal to |LAG|. These two steps taken together are intended to phase align the extrapolated signal and the received signal in the first good frame. At step 510, PLC module 306 overlap-adds time-aligned samples of the extrapolated signal and the delayed received signal starting at sample |LAG|+1 in the first good frame and ending at sample |LAG|+OLAWS+1 in the first good frame, wherein OLAWS represents the size of the overlap-add window. This generates a modified received signal starting at sample |LAG|+1 in the first good frame. At step 512, PLC module 306 applies time-warping to shrink the modified received signal in the first good frame and in subsequent good frames as necessary to re-align the modified received signal with the original received signal (or equivalently, until the delay introduced during step 508 is exhausted) in a manner that allows for natural phase evolution of the modified received signal and that does not introduce an audible distortion. PLC module 306 provides the modified frame(s) to audio output module 308 for use in generating the output audio signal.

Various methods may be used to shrink the received signal. For example, as described in U.S. patent application Ser. No. 11/838,908, a piece-wise single sample shift and overlap-add may be used. In accordance with this approach, a sample is periodically dropped. From this point of sample drop, the original received signal and the signal shifted back in time (due to the drop) are overlap-added.

During step 512, the amount of time-warping applied to the modified received signal may be set to a maximum amount that can be applied without introducing an audible distortion into the output audio signal produced by system 300. In an embodiment in which shrinking is achieved by using a piece-wise single sample shift and overlap-add as described above, the amount of time-warping applied may be controlled by adjusting the period at which the sample drop and overlap-add occurs.

Figure 2:
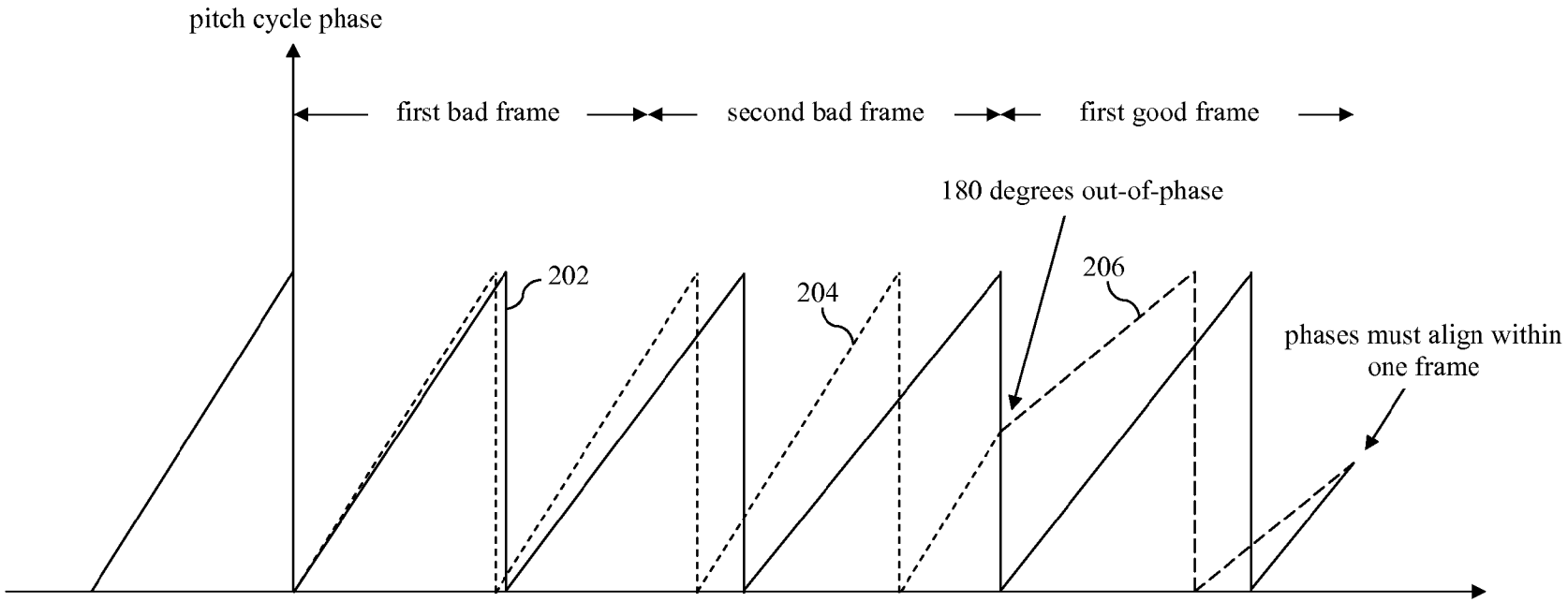
FIG. 2 is a diagram that illustrates the application of a conventional PLC method to align an extrapolated waveform generated during packet loss with a received signal obtained after the period of packet loss.

If the amount of time-warping applied during step 512 results in the time-warped signal being out of alignment with the original received signal at the end of the first good frame, the time-warping can advantageously be extended into the next good frame or frames following the first good frame until such time as these signals are aligned. This is in contrast to certain prior art solutions described herein (such as that illustrated in FIG. 2), in which the time-warped signal and the received signal must be phase-aligned by the end of the first good frame. This ensures that time-warping can always be used to facilitate phase alignment of the extrapolated signal and the received signal without introducing an audible distortion.

FIG. 6 is a diagram that illustrates the application of steps 506, 508, 510 and 512 of flowchart 500 to transition between an extrapolated signal 604 generated by PLC module 306 during first and second bad frames associated with a period of packet loss and a received signal 602. The scenario depicted in FIG. 6 is similar to that presented in FIG. 2. However, at the start of the first good frame after packet loss, extrapolated signal 604 is extended into the first good frame to the point that the phase matches that of the start of received signal 602 in the first good frame. In actuality, as discussed above in reference to step 510 of flowchart 500, extrapolated signal 604 is extended farther to enable an overlap-add operation, although this is not illustrated in FIG. 6. Received signal 602 is then delayed by the amount that extrapolated signal 604 was extended. These signals are then overlap-added to generate a modified received signal and the modified received signal is time-warped (shrunk) to ensure that the modified received signal is eventually realigned with the original received signal. The time-warped signal is denoted signal 606 in FIG. 6. As demonstrated in that figure, the amount of time-warping applied results in the phase of the time-warped signal matching that of the un-warped received signal in a good frame received subsequent to the first good frame. Thus, as illustrated in FIG. 6, the rate at which the modified received signal is time-warped can be spread over sufficient time to enable the time-warping to be inaudible. It is noted that if the phases of the extrapolated signal and the received signal are only slightly misaligned at the boundary between the second bad frame and the first good frame, the application of time-warping may realign the phases within the boundaries of the first good frame.

Returning now to the description of flowchart 500 of FIG. 5, if PLC module 306 determines during decision step 504 that the time lag determined during step 404 of FIG. 4 is not negative (i.e., the received signal lags the extrapolated signal), then control flows to step 514. During step 514, PLC module 306 determines if the application of time-warping to stretch the received signal in the first good frame backward in time by a number of samples equal to the time lag will result in an audible distortion. This step may involve determining if the amount of stretching that would need to be applied exceeds a predetermined amount of time or samples per frame or performing some other test.

Control then flows to decision step 516. In accordance with decision step 516, if it is determined during step 514 that the application of time-warping to stretch the received signal in the first good frame backward in time by a number of samples equal to the time lag will not result in an audible distortion, then steps 518 and 520 are performed to merge the extrapolated signal that was extended into the first good frame with the received signal. In particular, during step 518, PLC module 306 applies time-warping to stretch the received signal in the first good frame backward in time by a number of samples equal to the time lag. This stretching will generate excess samples prior to the start of the first good frame which are discarded. This step is intended to phase align the extrapolated signal and the received signal in the first good frame. At step 520, PLC module 306 overlap-adds OLAWS time-aligned samples of the extrapolated signal and the stretched received signal starting at the beginning of the first good frame to generate a modified first good frame, wherein OLAWS represents the overlap-add window size. PLC module 306 then provides the modified first good frame to audio output module 308 for use in generating the output audio signal.

Various methods may be used to stretch the received signal. For example, as described in U.S. patent application Ser. No. 11/838,908, a piece-wise single sample shift and overlap-add may be used. In accordance with this approach, a sample is periodically repeated. From that point of sample repeat, the original received signal and the signal shifted forward in time (due to the sample repeat) are overlap-added.

FIG. 7 is a diagram that illustrates the application of steps 518 and 520 of flowchart 500 to transition between an extrapolated signal 704 generated by PLC module 306 during a bad frame associated with a period of packet loss and a received signal 702. In accordance with this example, received signal 702 is stretched backward in time in a manner that anchors the last sample of the first good frame. The time-warped signal is denoted signal 706 in FIG. 7. The stretching generates excess samples prior to the first good frame which are discarded. Time-warped signal 706 and extrapolated signal 704 are then overlap-added at the beginning of the first good frame to produce a modified first good frame. In accordance with this approach, no delay is introduced and phase alignment between the time-warped version of the received signal and the original received signal is achieved within the first good frame.

Since the approach used in steps 518 and 520 phase aligns the extrapolated signal and the received signal in a manner that does not introduce delay it should be used whenever such an approach does not introduce an audible distortion. This is achieved in flowchart 500 through the operation of steps 514 and decision step 516. However, if during decision step 516, PLC module 306 determines that the application of time-domain stretching will result in an audible distortion, steps 522, 524, 526 and 528 shown in FIG. 5B are instead performed to merge the extrapolated signal that was extended into the first good frame with the received signal.

In particular, at step 522, PLC module 306 replaces the first (PP−LAG) samples of the received signal in the first good frame with time-aligned samples from the extrapolated speech signal in the first good frame, wherein PP represents the pitch period of the extrapolated signal. At step 524, PLC module 306 delays the received speech signal in the first good frame by a number of samples equal to (PP−LAG). These two steps taken together are intended to phase align the extrapolated signal and the received signal in the first good frame. At step 526, PLC module 306 overlap-adds time-aligned samples of the extrapolated signal and the delayed received signal starting at sample (PP−LAG)+1 in the first good frame and ending at sample (PP−LAG+OLAWS)+1 in the first good frame, wherein OLAWS represents the size of the overlap-add window. This generates a modified received signal starting at sample (PP−LAG)+1 in the first good frame. At step 528, PLC module 306 applies time-warping to shrink the modified received signal in the first good frame and in subsequent good frames as necessary to re-align the modified received signal with the original received signal (or equivalently, until the delay introduced during step 524 is exhausted) in a manner that allows for natural phase evolution of the modified received signal and that does not introduce an audible distortion. PLC module 306 provides the modified frame(s) to audio output module 308 for use in generating the output audio signal.

During step 528, the amount of time-warping applied to the modified received signal may be set to a maximum amount that can be applied without introducing an audible distortion into the output audio signal produced by system 300. If the amount of time-warping applied during step 528 results in the time-warped signal being out of alignment with the original received signal at the end of the first good frame, the time-warping can advantageously be extended into the next good frame or frames following the first good frame until such time as these signals are aligned.

The application of the "shift and shrink" approach described above in reference to steps 522, 524, 526 and 528 of flowchart 500 may be used instead of the "stretching" approach described above in reference to steps 518 and 520 to merge the extrapolated signal with the received signal since phase alignment can be achieved both by stretching the received signal back in time by the time lag as well as by delaying the received signal by a number of samples equal to the pitch period of the extrapolated signal less the time lag and then shrinking it. As discussed above, the "shift and shrink" approach is only used where the "stretching" approach would result in the introduction of an audible distortion, since the "stretching" approach does not introduce delay. Another reason for using the "stretching" approach when it does not result in the introduction of an audible distortion is that the "stretching" approach avoids having to use the extrapolated signal during the first good frame which itself causes distortion.

In accordance with the stretching approach, since no delay is introduced, PLC module 306 can treat subsequent bad frames in a normal manner (e.g., by applying PWE to replace the entirety of the bad frame). In contrast, in accordance with a "shift and shrink" approach (which can refer to steps 506, 508, 510 and 512 as well as to steps 522, 524, 526 and 528 of flowchart 500), it is possible that there may still be delayed samples remaining at the time of the next bad frame. In accordance with an embodiment of the present invention, these delayed samples may advantageously be used to generate a concealment waveform for the next bad frame.

This approach will now be described in reference to flowchart 800 of FIG. 8.

Although the method of flowchart 800 will be described herein with continued reference to components of example system 300 as described above in reference to FIG. 3, persons skilled in the relevant art(s) will appreciate that the method is not so limited, and may be performed by other components or systems.

As shown in FIG. 8, the method of flowchart 800 begins at step 802 in which PLC module 306 delays a received signal associated with one or more good frames of an audio signal to phase align the received signal with a PLC signal associated with one or more bad frames that preceded the good frame(s). For example, PLC module 306 may perform this step by performing steps 508 or 524 of flowchart 500 as described above in reference to FIGS. 5A and 5B. The performance of step 802 will result in the generation of a plurality of delayed samples. These delayed samples may be stored, for example, in a buffer accessible to PLC module 306.

At step 804, PLC module 306 overlap-adds the delayed received signal and the PLC signal associated with the bad frame(s) that preceded the good frame(s) to generate a modified received signal. For example, PLC module 306 may perform this step by performing steps 510 or 526 of flowchart 500 as described above in reference to FIGS. 5A and 5B.

At step 806, PLC module 306 applies time-warping to shrink the modified received signal over a predetermined time period, thereby gradually reducing the number of delayed samples as the modified received signal and the original received signal gradually realign. For example, PLC module 306 may perform this step by performing steps 512 or 528 of flowchart 500 as described above in reference to FIGS. 5A and 5B.

At step 808, PLC module 306 determines that a frame following the good frame(s) is bad. PLC module 306 may make this determination, for example, based on information received from frame classifier 304.

At decision step 810, PLC module 306 determines if there are any delayed samples remaining. If there are no delayed samples remaining, then PLC module 306 will generate a PLC signal associated with the bad frame following the good frame(s) by applying a prediction-based PLC algorithm as shown in step 812. For example, PLC module 306 may perform periodic waveform extrapolation to generate the PLC signal associated with the bad frame following the good frame(s), although this is only an example and other PLC methods may be used.

However, if PLC module 306 determines during decision step 810 that there are delayed samples remaining, then PLC module 306 will use the remaining delayed samples to generate a first portion of a PLC signal associated with the bad frame following the good frame(s) and apply a prediction-based PLC algorithm to generate a second portion of the PLC signal associated with the bad frame as shown at step 814. By performing this step, PLC module 306 effectively reduces the duration of the packet loss.

FIG. 9 is a diagram that illustrates the application of the method of flowchart 800. As shown in FIG. 9, PLC module 306 phase aligns an extrapolated signal 902 generated during a series of bad frames with a received signal 902 in the first good frame after the bad frames by delaying received signal 902. As noted above, this results in the generation of delayed samples. Time-warping is also applied to the delayed received signal 902 to generate a time-warped received signal 906. Immediately after the first good frame, another bad frame (denoted "first bad frame" in FIG. 9) is encountered. At this point, time-warped received signal 906 still leads original received signal 902, which means that there are delayed samples remaining. As further shown in FIG. 9, these remaining delayed samples can be used to generate a first portion of a concealment signal during the first bad frame, thereby effectively reducing the period of packet loss.

In one embodiment, the amount of time-warping applied to the delayed received signal (which may also be thought of as the rate at which shrinking is applied to the delayed received signal or, in one particular implementation described above, the rate at which a sample drop and overlap-add is applied to the delayed received signal) is made dependent upon at least one metric that is representative of the quality of a channel over which the audio signal is being received. For example, the amount of time-warping applied to the delayed received signal may be dependent upon a packet loss rate or a signal-to-noise ratio (SNR) associated with the channel over which the audio signal is being received.

For example, an embodiment will now be described in which the amount of time-warping applied to the delayed received signal is dependent upon a packet loss rate associated with the channel over which the audio signal is being received. In accordance with this embodiment, when the packet loss rate is relatively low (e.g., below some predetermined threshold), the amount of time warping applied is automatically set to be the maximum amount of time warping that can be applied without introducing an audible distortion. This favors rapid re-alignment of the delayed received signal with the actual received signal. However, if the packet loss rate is relatively high (e.g., above some predetermined threshold), then the amount of time warping applied is automatically set to some amount that is less than the maximum amount that can be applied without introducing an audible distortion. By reducing the amount of time-warping applied (or, equivalently, reducing the rate of shrinking applied) to the delayed received signal, re-alignment with the actual received signal will take longer; however, the trade-off is that delayed samples will be consumed more slowly during the re-alignment process, meaning that more delayed samples will be available when the next packet loss occurs to generate a concealment signal. This approach thus achieves rapid elimination of the transient delay introduced by time-warping when the packet loss rate is low while extending and leveraging the same transient delay to buffer received signal samples when the packet loss rate is high.

D. Time-Warped Packet Loss Concealment for Improved Performance in Transition Frames As discussed in the Background Section above, one major source of distortion associated with PLC is the loss of one or more frames that include transitions, such as (a) transitions from unvoiced to voiced sounds, (b) transitions from voiced to unvoiced sounds, and (c) transitions from one voice sound to another voiced sound. FIG. 10 illustrates three audio waveforms that include each of these transition types. In particular, waveform (a) in FIG. 10 represents an unvoiced to voiced (UV-V) transition, waveform (b) in FIG. 10 represents a voiced to unvoiced (V-UV) transition and waveform (c) in FIG. 10 represents a transition from one voice sound to another (V-V).

The loss of frame(s) including such transitions can be particularly problematic for conventional prediction-based PLC schemes in which only the past speech is available. For such schemes, the upcoming transition is not known or very difficult to accurately predict. A conventional prediction-based PLC scheme may conceal the transition with the previous signal type and then perform an overlap-add of the different signals in the first good frame. Unfortunately, the overlap-add of these different signals does not accurately reproduce the transition region and an audible artifact often results.

An embodiment of the present invention can apply time-warping (and in particular, shrinking) to provide significant improvement in audio quality in these situations. FIG. 11 depicts a flowchart 1100 of a method in accordance with such an embodiment. The method of flowchart 1100 may be used to perform prediction-based PLC in a manner that can conceal the loss of one or more frames containing a transition region without resulting in an audible artifact. The steps of flowchart 1100 may be performed, for example, by PLC module 306 as described above in reference to system 300 of FIG. 3. However, the method is not limited to that implementation.

As shown in FIG. 11, the method of flowchart 1100 begins at step 1102 in which PLC module 306 analyzes a first good frame following one or more bad frames in a series of frames representing a speech signal to determine if a transition from a first type of speech to a second type of speech occurred during the bad frame(s). Depending upon the implementation, PLC module 306 may be configured to determine if a transition from unvoiced speech to voiced speech has occurred, to determine if a transition from voiced speech to unvoiced speech has occurred, and/or to determine if a transition from one type of voiced speech to another type of voiced speech has occurred.

At decision step 1104, if PLC module 306 determines that no transition has occurred, then control will flow to step 1116 in which PLC module 306 merges a PLC signal generated during the bad frame(s) with a received portion of the speech signal beginning in the first good frame. This step may be performed using various conventional methods or any of the methods described above in reference to FIGS. 4, 5A and 5B.

However, if PLC module 306 determines during decision step 1104 that a transition has occurred, then control flows to step 1106. During step 1106, PLC module 306 synthesizes a signal that represents the transition. For example, this step may comprise generating a signal that represents a transition from unvoiced to voiced speech, from voiced to unvoiced speech, or from one type of voiced speech to another.

At step 1108, PLC module 306 delays a received portion of the speech signal beginning in the first good frame by the amount of time required to synthesize the signal that represents the transition.

At step 1110, PLC module 306 inserts the synthesized signal in front of or before the delayed received portion of the speech signal.

At step 1112, PLC module 306 combines a final portion of the synthesized signal with an initial portion of the delayed received portion of the speech signal to avoid discontinuity between the two signals. This step may comprise, for example, overlap adding the two signal portions.

Finally, at step 1114, PLC module 306 applies time-domain shrinking to the delayed received portion of the speech signal to bring the delayed received portion of the speech signal into alignment with the received portion of the speech signal after a period of time. This step may include applying time-domain shrinking to the first good frame as well as one or more additional good frames received after the first good frame as necessary in order to effect the time-domain shrinking in a manner that would be inaudible to a user.

FIG. 12 illustrates the application of the method of flowchart 1100 to perform PLC in a scenario in which a frame of an original speech signal 1202 that includes a transition has been lost. In particular, as shown in FIG. 12, during a lost frame of original speech signal 1202, a transition from one type of voiced speech to a different type of voiced speech has occurred. During the lost frame, prediction-based PLC is performed to generate a PLC waveform which is part of a reconstructed signal 1204. Since prediction-based PLC is used, the PLC waveform that is generated is very similar to the waveform that preceded the lost frame and represents essentially the same type of voiced sound. Thus, the PLC waveform does not represent the lost transition. However, analysis of the first good frame received after the lost frame shows that a transition has occurred. Accordingly, a synthesized transition is inserted into reconstructed waveform 1204 prior to a delayed version of the original signal. Furthermore, time warping is applied to the delayed version of the original signal until the added delay from the insertion of the synthesized transition is exhausted.

Thus, in accordance with the method of flowchart 1100, a "shift and shrink" approach can be used to provide the "look-ahead" required to handle transition frames for prediction-based PLC in much the same way as a fixed delay buffer provides a look-ahead for estimation-based PLC. One advantage of the method of flowchart 1100 is that the delay is only temporary and is incurred only when needed. During times of no packet loss, the method of flowchart 1100 incurs no additional delay. When a frame that includes a transition is lost or otherwise declared bad, a small temporary delay is incurred and is quickly eliminated using time-warping. In addition, the temporary delay may be much less than a fixed delay incurred by a fixed delay buffer since the latter scheme is typically limited to be a multiple of the frame size. For example, if the frame size is 10 ms, this would be the minimum delay incurred by a typical fixed delay buffer scheme. However, the transition may require much less time than this to synthesize (5 ms for example) and hence the method of flowchart 1100 may incur less delay.

E. Example Computer System Implementations

The following description of a general purpose computer system is provided for the sake of completeness. The present invention can be implemented in hardware, software, firmware, or any combination thereof. Consequently, the invention may be implemented in the environment of a computer system or other processing system. An example of such a computer system 1700 is shown in FIG. 17.

Computer system 1300 includes a processing unit 1304. Processing unit 1304 may comprise one or more processors or processor cores. Processor unit 1304 can include a special purpose or a general purpose digital signal processor. Processing unit 1304 is connected to a communication infrastructure 1302 (for example, a bus or network). Various software implementations are described in terms of this exemplary computer system. After reading this description, it will become apparent to a person skilled in the relevant art(s) how to implement the invention using other computer systems and/or computer architectures.

Computer system 1300 also includes a main memory 1306, preferably random access memory (RAM), and may also include a secondary memory 1320. Secondary memory 1320 may include, for example, a hard disk drive 1322 and/or a removable storage drive 1324, representing a floppy disk drive, a magnetic tape drive, an optical disk drive, or the like. Removable storage drive 1324 reads from and/or writes to a removable storage unit 1328 in a well known manner. Removable storage unit 1328 represents a floppy disk, magnetic tape, optical disk, or the like, which is read by and written to by removable storage drive 1324. As will be appreciated by persons skilled in the relevant art(s), removable storage unit 1328 includes a computer usable storage medium having stored therein computer software and/or data.

In alternative implementations, secondary memory 1320 may include other similar means for allowing computer programs or other instructions to be loaded into computer system 1300. Such means may include, for example, a removable storage unit 1330 and an interface 1326. Examples of such means may include a program cartridge and cartridge interface (such as that found in video game devices), a removable memory chip (such as an EPROM, or PROM) and associated socket, and other removable storage units 1330 and interfaces 1326 which allow software and data to be transferred from removable storage unit 1330 to computer system 1300.

Computer system 1300 may also include a communications interface 1340. Communications interface 1340 allows software and data to be transferred between computer system 1300 and external devices. Examples of communications interface 1340 may include a modem, a network interface (such as an Ethernet card), a communications port, a PCMCIA slot and card, etc. Software and data transferred via communications interface 1340 are in the form of signals which may be electronic, electromagnetic, optical, or other signals capable of being received by communications interface 1340. These signals are provided to communications interface 1340 via a communications path 1342. Communications path 1342 carries signals and may be implemented using wire or cable, fiber optics, a phone line, a cellular phone link, an RF link and other communications channels.

As used herein, the terms "computer program medium" and "computer usable medium" are used to generally refer to tangible media such as removable storage units 1328 and 1330 or a hard disk installed in hard disk drive 1322. These computer program products are means for providing software to computer system 1300.

Computer programs (also called computer control logic) are stored in main memory 1306 and/or secondary memory 1320. Computer programs may also be received via communications interface 1340. Such computer programs, when executed, enable the computer system 1300 to implement aspects of the present invention as discussed herein. In particular, the computer programs, when executed, enable processing unit 1304 to implement the processes of the present invention, such as any of the methods described herein. Accordingly, such computer programs represent controllers of the computer system 1300. Where the invention is implemented using software, the software may be stored in a computer program product and loaded into memory of computer system 1300 using removable storage drive 1324, interface 1326, or communications interface 1340.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

E. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method for merging a concealment signal generated to replace one or more bad frames of an audio signal with a received signal representing one or more good frames of the audio signal received after the bad frame(s), comprising:

extending the concealment signal into the first good frame received after the bad frame(s);

calculating a time lag between the concealment signal and the received signal in the first good frame, wherein the time lag represents a phase difference between the concealment signal and the received signal in the first good frame;

if the time lag is negative, delaying the received signal based on the time lag to generate a first delayed received signal, overlap adding the first delayed received signal and a portion of the concealment signal in the first good frame to generate a first modified received signal, and shrinking the first modified received signal over one or more frames of the audio signal to align the phase of the first modified received signal to that of the received signal.

2. The method of claim 1, wherein delaying the received signal based on the time lag comprises delaying the received signal by a number of samples equal to the absolute value of the time lag.

3. The method of claim 1, further comprising:

if the time lag is positive, determining if stretching the received signal in the first good frame backward in time based on the time lag will result in an audible distortion, and responsive to determining that stretching the received signal in the first good frame backward in time based on the time lag will not result in an audible distortion, stretching the received signal in the first good frame backward in time based on the time lag and overlap-adding a portion of the stretched received signal and a portion of the concealment waveform in the first good frame.

4. The method of claim 3, wherein stretching the received signal in the first good frame backward in time based on the time lag comprises stretching the received signal in the first good frame backward in time by a number of samples equal to the time lag.

5. The method of claim 3, further comprising:

responsive to determining that stretching the received signal in the first good frame back backward in time based on the time lag will result in an audible distortion, delaying the received signal based on a pitch period of the concealment signal less the time lag to generate a second delayed received signal, overlap adding the second delayed received signal and a portion of the concealment signal in the first good frame to generate a second modified received signal, and shrinking the second modified received signal over one or more frames of the audio signal to align the phase of the modified received signal to that of the received signal.

6. The method of claim 5, wherein delaying the received signal based on the pitch period of the concealment signal less the time lag comprises delaying the received signal by a number of samples equal to the pitch period of the concealment signal less a number of samples equal to the time lag.

7. The method of claim 1, wherein shrinking the first modified received signal over one or more frames of the audio signal to align the phase of the first modified received signal to that of the received signal comprises:

applying a rate of shrinking to the first modified received signal that is determined based on at least one metric representative of a quality of a channel over which the audio signal is received.

8. The method of claim 1, wherein applying a rate of shrinking to the first modified received signal that is determined based on at least one metric representative of a quality of a channel over which the audio signal is received comprises:

applying a rate of shrinking to the first modified received signal that is determined based on a packet loss rate associated with the channel over which the audio signal is received.

9. A system, comprising:

a packet loss concealment (PLC) module that is configured to generate a concealment signal to replace one or more bad frames of an audio signal;

an audio decoding module configured to generate a received signal representing one or more good frames of an audio signal received after the bad frame(s);

wherein the PLC module is further configured to extend the concealment signal into the first good frame received after the bad frame(s), to calculate a time lag between the concealment signal and the received signal in the first good frame, and to perform the following if the time lag is negative: delay the received signal based on the time lag to generate a first delayed received signal, overlap-add the first delayed received signal and a portion of the concealment signal in the first good frame to generate a first modified received signal, and shrink the first modified received signal over one or more frames of the audio signal to align the phase of the first modified received signal to that of the received signal.

10. The system of claim 9, wherein the PLC module is further configured to perform the following if the time lag is positive:

determine if stretching the received signal in the first good frame backward in time based on the time lag will result in an audible distortion, and responsive to a determination that stretching the received signal in the first good frame backward in time based on the time lag will not result in an audible distortion, stretch the received signal in the first good frame backward in time based on the time lag and overlap-adding a portion of the stretched received signal and a portion of the concealment waveform in the first good frame.

11. The system of claim 10, wherein the PLC module is further configured to perform the following if the time lag is positive:

responsive to a determination that stretching the received signal in the first good frame back backward in time based on the time lag will result in an audible distortion, delay the received signal based on a pitch period of the concealment signal less the time lag to generate a second delayed received signal, overlap-add the second delayed received signal and a portion of the concealment signal in the first good frame to generate a second modified received signal, and shrink the second modified received signal over one or more frames of the audio signal to align the phase of the modified received signal to that of the received signal.

12. A method for performing packet loss concealment (PLC), comprising:

delaying a received signal associated with one or more good frames of an audio signal to phase align the received signal with a PLC signal associated with one or more bad frames of the audio signal that preceded the good frame(s), wherein delaying the received signal generates a plurality of delayed samples;

determining that a frame of the audio signal following the good frame(s) is a bad frame; and using one or more of the delayed samples to generate a PLC signal associated with the bad frame following the good frame(s).

13. The method of claim 12, further comprising:

overlap-adding the PLC signal associated with the bad frame(s) that preceded the good frame(s) and the delayed received signal to generate a modified received signal.

14. The method of claim 13, further comprising:

applying time-warping to shrink the modified received signal over a predetermined time period, wherein the application of the time-warping gradually reduces the number of delayed samples;

wherein using one or more of the delayed samples to generate the PLC signal associated with the bad frame following the good frame(s) comprises using one or more of the delayed samples to generate the PLC signal associated with the bad frame following the good frame(s) if there are any delayed samples remaining.

15. The method of claim 14, wherein applying time-warping to shrink the modified received signal over a predetermined time period comprises:

applying a rate of shrinking to the modified received signal that is determined based on at least one metric representative of a quality of a channel over which the audio signal is received.

16. The method of claim 15, wherein applying a rate of shrinking to the modified received signal that is determined based on at least one metric representative of a quality of a channel over which the audio signal is received comprises:

applying a rate of shrinking to the modified received signal that is determined based on a packet loss rate associated with the channel over which the audio signal is received.

17. The method of claim 12, wherein using one or more of the delayed samples to generate the PLC signal associated with the bad frame following the good frame(s) comprises:

using one or more of the delayed samples to generate a first portion of the PLC signal associated with the bad frame following the good frame(s); and performing prediction-based PLC to generate a second portion of the PLC signal associated with the bad frame following the good frame(s).

18. The method of claim 17, wherein performing prediction-based PLC to generate the second portion of the PLC signal associated with the bad frame following the good frame(s) comprises:

performing periodic waveform extrapolation.

19. A system, comprising:

an audio decoding module configured to generate a received signal associated with one or more good frames of an audio signal;

a packet loss concealment (PLC) module configured to delay the received signal to phase align the received signal with a PLC signal associated with one or more bad frames of the audio signal that preceded the good frame(s), thereby generating a plurality of delayed samples, to determine that a frame of the audio signal following the good frame(s) is a bad frame, and to use one or more of the delayed samples to generate a PLC signal associated with the bad frame following the good frame(s).

20. The system of claim 19, wherein the PLC module is further configured to overlap-add the PLC signal associated with the bad frame(s) that preceded the good frame(s) and the delayed received signal to generate a modified received signal.

21. The system of claim 20, wherein the PLC module is further configured to apply time-warping to shrink the modified received signal over a predetermined time period, thereby gradually reducing the number of delayed samples, and to use one or more of the delayed samples to generate the PLC signal associated with the bad frame following the good frame(s) if there are any delayed samples remaining.

22. The system of claim 19, wherein the PLC module is configured to use one or more of the delayed samples to generate a first portion of the PLC signal associated with the bad frame following the good frame(s) and to perform prediction-based PLC to generate a second portion of the PLC signal associated with the bad frame following the good frame(s).

23. The system of claim 22, wherein the PLC module is configured to perform prediction-based PLC to generate the second portion of the PLC signal associated with the bad frame following the good frame(s) by performing periodic waveform extrapolation.

24. A method for performing packet loss concealment, comprising:

analyzing a first good frame following one or more bad frames in a series of frames representing a speech signal to determine if a transition from a first type of speech to a second type of speech occurred during the bad frame(s); and responsive to determining that the transition from the first type of speech to the second type of speech occurred during the bad frame(s):

synthesizing a signal that represents the transition;

delaying a received portion of the speech signal beginning in the first good frame by an amount of time required to synthesize the signal that represents the transition;

inserting the synthesized signal before the delayed received portion of the speech signal; and applying time-domain shrinking to the delayed received portion of the speech signal to bring the delayed received portion of the speech signal into alignment with the received portion of the signal after a period of time.

25. The method of claim 24, wherein analyzing the first good frame to determine if a transition from a first type of speech to a second type of speech occurred during the bad frame(s) comprises analyzing the first good frame to determine if one or more of the following transitions occurred during the bad frame(s):

a transition from unvoiced speech to voiced speech;

a transition from voiced speech to unvoiced speech; and a transition from one type of voiced speech to another type of voiced speech.

26. The method of claim 24, further comprising combining a portion of the synthesized signal with a portion of the delayed received portion of the speech signal.

27. The method of claim 26, wherein combining the portion of the synthesized signal with the portion of the delayed received portion of the speech signal comprises:

overlap-adding the portion of the synthesized signal with the portion of the delayed received portion of the speech signal.

* * * * *